US005078057A

United States Patent [19]

Pearson

[11] Patent Number: 5,078,057

[45] Date of Patent: Jan. 7, 1992

[54] BINDING MACHINE, SUCH AS STRAPPING MACHINE

[75] Inventor: Timothy B. Pearson, Antioch, Ill.

[73] Assignee: Illinois Tool Works Inc., Glenview, Ill.

[21] Appl. No.: 461,542

[22] Filed: Jan. 5, 1990

[51] Int. Cl.[5] ..... B65B 13/06

[52] U.S. Cl. ..... 100/25; 100/26; 100/7; 100/29; 100/33 PB

[58] Field of Search ..... 100/7, 25, 26, 29, 33 PB, 100/2; 53/589

[56] References Cited

U.S. PATENT DOCUMENTS

| | | | |
|---|---|---|---|
| 3,379,121 | 4/1968 | Lems | 100/2 |
| 4,156,443 | 5/1979 | Nishikawa | 140/101 |
| 4,378,262 | 3/1983 | Annis, Jr. | 156/73.5 |
| 4,578,933 | 4/1986 | Lang et al. | 53/589 |

*Primary Examiner*—Paul T. Sewell
*Assistant Examiner*—Thomas P. Hilliard
*Attorney, Agent, or Firm*—T. W. Buckman; D. J. Breh; J. P. O'Brien

[57] ABSTRACT

A binding machine, such as a strapping machine, for binding a bundle of newspapers or magazines by applying crossed straps around the bundle. Means are provided for conveying the bundle into and from a strapping zone. Means including a strapping head for each strap are provided for applying a transverse strap and a longitudinal strap around the bundle. A transverse chute is provided, which receives the transverse strap, which guides the transverse strap around the bundle, and which releases the transverse strap when the transverse strap is applied. A longitudinal chute is provided, which receives the longitudinal strap, which guides the longitudinal strap around the bundle, and which releases the longitudinal strap when the longitudinal strap is applied. The transverse chute arches from a given side of the strapping zone to its other side. The longitudinal chute arches from a given end of the strapping zone to its other end but is curved and twisted so as to be laterally displaced from the strapping zone at each such end. Means are provided for deflecting the strap released by the longitudinal chute so as to center such strap. Further, means are provided for supplying such a strap to the strapping head for the longitudinal strap, along with a curved and twisted chute for guiding such a strap between the longitudinal strap-supplying means and the longitudinal strap-applying means. Each curved and twisted chute directs such a strap along a serpentine path.

22 Claims, 12 Drawing Sheets

BINDING MACHINE, SUCH AS STRAPPING MACHINE

TECHNICAL FIELD OF THE INVENTION

This invention pertains to a binding machine, such as a strapping machine, which is useful in binding bundles by applying crossed straps, wires, or other binding elements. The strapping machine is useful particularly but not exclusively with bundles of newspapers, magazines, or like items, which tend to be somewhat slippery.

BACKGROUND OF THE INVENTION

Binding of bundles of newspapers, magazines, or like items presents special problems, which designers of binding machines, such as strapping machines, must address. Because such items often tend to be somewhat slippery in relation to one another, particularly if such items comprise glossy advertising inserts or similar materials, it often is a practical necessity to bind a bundle of such items by applying crossed polymeric or metal straps, round or flat wires, or other binding elements around the bundle. High conveying and binding speeds are mandated, in many instances, and spatial considerations are important.

Commonly, polymeric straps are used, as exemplified by oriented poly(ethylene terephthalate) or polypropylene straps, which may be heat-welded, joined with metal seals or joined otherwise at overlapped ends so as to form closed loops. Usually, such straps cross each other at right angles, along opposite faces of the bundle.

In prior machines for strapping loads of diverse types by applying crossed straps, three basic approaches are used, as explained below. If a load is strapped with two straps crossing each other at right angles, and with reference to a forward direction of the load, it is convenient to refer to one such strap as a longitudinal strap and to refer to the other strap as a transverse strap. A given load may have a plurality of longitudinal straps, a plurality of transverse straps, or both.

A first approach, as exemplified in Mertens U.S. Pat. No. 3,031,816, has been to apply the longitudinal and transverse straps around a load, in either order, at successive locations along a conveyor for the load. As exemplified in the Mertens patent, each longitudinal strap is pre-draped so as to extend vertically along a front face of a load. As a variation of the first approach, it is known to apply a first strap in a first strapping machine, to rotate the load by a quarter-turn, and to apply a second strap in a second strapping machine. Although it may be very useful in other applications, a strapping machine employing the first approach tends to be too long and too slow to be ordinarily used in strapping bundles of newspapers, magazines, or like items.

A second approach, as exemplified in Pasic U.S. Pat. No. 4,312,266, has been to apply a first strap around a load in a single strapping zone, to rotate the load by a quarter-turn, about a vertical axis, after the first strap has been applied, and to apply a second strap onto the load in the same strapping zone. Typically, complex mechanisms are used to rotate the load. Although it may be very useful in other applications, a strapping machine employing the second approach tends to be too slow to be ordinarily used in strapping bundles of newspapers, magazines, or like items.

Moreover, under the first or second approach, rotation of the load tends to disturb the load, particularly if the load comprises slippery items such as glossy advertising inserts for newspapers.

A third approach, as exemplified in Lang et al. U.S. No. 4,578,933, is to convey a load in a forward direction, into a strapping zone, with the load oriented in a particular way. The load is oriented with its vertical faces at angles of about 45° relative to the forward direction. In the strapping zone, the longitudinal and transverse straps are applied onto the load, in either order. An advantage of the third approach is that strap guides and similar structures are positionable so as not to interfere with a load being conveyed into or from the strapping zone. A disadvantage of the third approach, however, is that the unstrapped load must be initially oriented with its vertical faces at the angles noted above. Thus, if the load is a bundle of newspapers, magazines, or like items, roation of the unstrapped bundle so as to orient its vertical faces at such angles can cause the newspapers or other items of the bundle to cascade, particularly if rotation is effected by mechanical means.

Any such approach requiring a bundle of newspapers, magazines, or like items to be somehow rotated before the bundle has been bound with crossed binding elements, such as straps is disfavored by many users because of their concerns over maintaining integrity of the bundle.

Hence, there has been a need, to which this invention is addressed, for a binding machine using a better approach to binding bundles of newspapers, magazines, or like items with crossed binding elements, such as straps.

SUMMARY OF THE INVENTION

This invention provides a binding machine, such as a strapping machine, which uses a novel approach to binding bundles of newspapers, magazines, or like items. Preferably, the binding machine is a strapping machine which straps of polymeric material, such as poly(ethylene terephthalate) or polypropylene, or like material around such bundles.

Broadly, the binding machine comprises a conveyor for conveying such a bundle into a binding zone, a binding head for applying such a binding element, in a tensioned loop, around such a bundle in the binding zone, and a chute having a novel configuration for guiding the binding element before it is applied. Thus, as explained below, the chute may be a chute used to guide the binding element around such a bundle. Also, as explained below, the chute may be a chute used to guide the binding element to a binding head. Broadly, the binding element may be a polymeric or metal strap, a round or flat wire, or the like.

According to this invention, the chute having the novel configuration is not only curved but also twisted, so as to direct the guided strap along a serpentine path. The serpentine path has at least one curve and at least one twist.

Such a chute, as curved and twisted, may be advantageously arranged to avoid interfering with such a bundle being conveyed into the binding zone, to guide a binding element around such a bundle in the strapping zone, and to release the binding element when it is applied.

The binding head may be a strapping head of a known type performing a series of known functions. The strapping head receives a strap of indefinite length, feeds the strap through a chute, around a bundle, and grips the leading end of the strap. Next, the strapping head tensions the strap so as to form a tensioned loop around the bundle, whereupon the strapping head welds the tensioned loop. Welding may be accomplished by a heated blade. After the tensioned loop has been welded, the strapping head severs the welded loop from the excess of the strap. It is convenient to refer to the strapping head as being used to apply the strap around the bundle.

If a dispenser is provided for supplying such a strap to the strapping head, such a chute, as curved and twisted, may be advantageously arranged to guide such a strap between the dispenser and the strapping head. Thus, the dispenser does not have to be generally aligned with the strapping head, as in prior strapping machines.

Preferably, the binding machine is a strapping machine, as mentioned above, which is arranged to apply two crossed straps around such a bundle. Thus, two strapping heads are provided, respectively for applying such a strap as a transverse strap and for applying such a strap as a longitudinal strap. Also, a transverse chute and a longitudinal chute are provided, each for receiving such a strap to be thus applied, for guiding such strap around such a bundle in the strapping zone, and for releasing the strap when it is applied.

Moreover, at least one of the transverse and longitudinal chutes is curved and twisted, so as to direct the strap guided thereby along a serpentine path with one or more curves and with one or more twists. It is preferred that a deflector is provided for deflecting such a strap as released by the curved and twisted chute so as to center the deflected strap onto such a bundle present within the strapping zone.

It is preferred that the transverse chute arches from one of the opposite sides of the strapping zone to its other side. As well, it is preferred that longitudinal chute arches from one of the opposite ends of the strapping zone to its other end but is curved and twisted so as to be laterally displaced from the strapping zone at each such end, preferably to the same side at each such end, thereby to avoid interfering with such a bundle being conveyed into the strapping zone.

Additionally, if the strapping machine includes a conveyor for conveying such a bundle from the strapping zone after such transverse and longitudinal straps have been applied, the longitudinal chute is arranged to avoid interfering with such a bundle being conveyed from the strapping zone. The strapping machine then may comprise suitable guides for guiding the strap released by the longitudinal chute so that such strap does not interfere with the conveyors.

The strapping machine can be compactly built and can be rapidly cycled, so as to be particularly useful in strapping bundles of newspapers, magazines, or like items by applying crossed straps.

These and other objects, features, and advantages of this invention are evident from the following description of a preferred embodiment of this invention with reference to the accompanying drawings.

DETAILED DESCRIPTION OF PREFERRED EMBODIMENT

Figure 1:
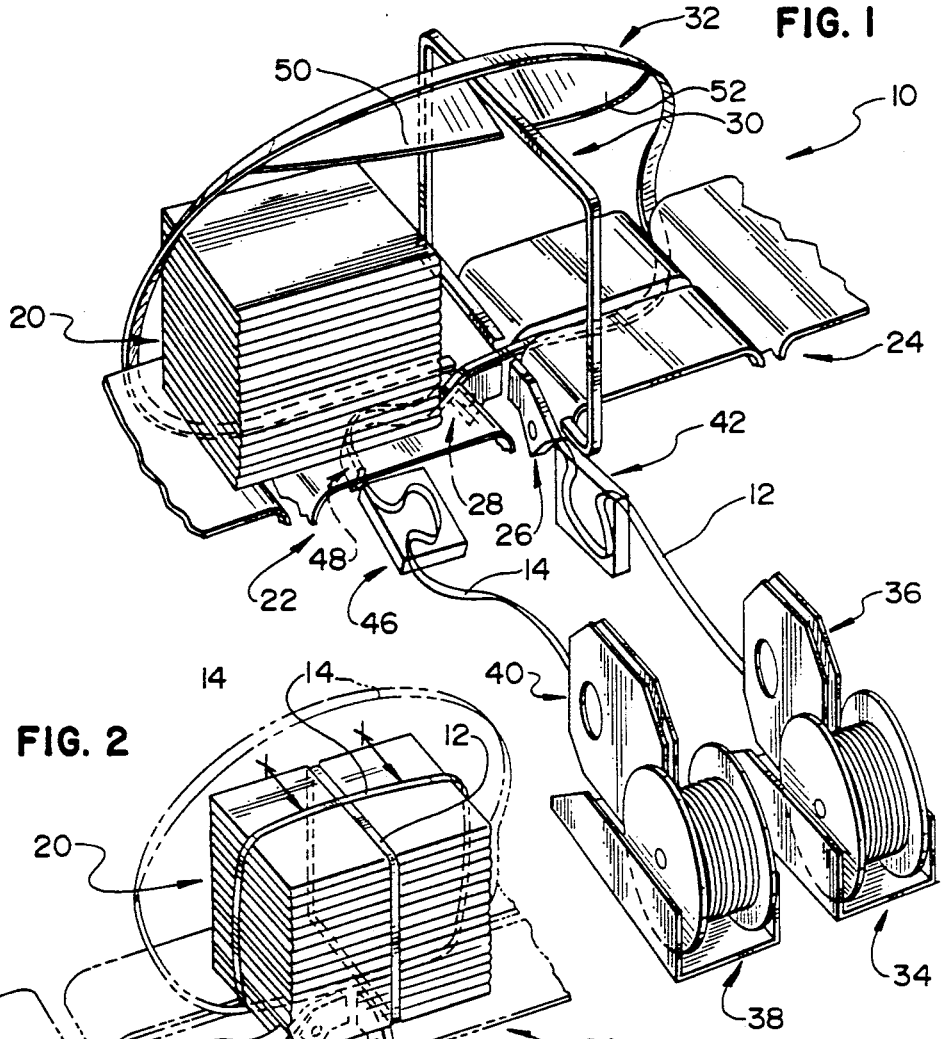
FIGS. 1 through 3 are perspective, diagrammatic representations of a bundle of folded newspapers being strapped with a transverse strap, and with a longitudinal strap, by a strapping machine embodying this invention. The bundle, the transverse and longitudinal straps, a strapping head associated with each strap, and a dispenser and strap accumulator associated with each strapping head are shown in full lines.

While this invention is susceptible of being embodied in many forms, a preferred embodiment is illustrated in the drawings and is to be hereinafter described, with the understanding that the present disclosure is an exemplification of this invention and is not intended to limit this invention to the illustrated embodiment.

Figure 2:
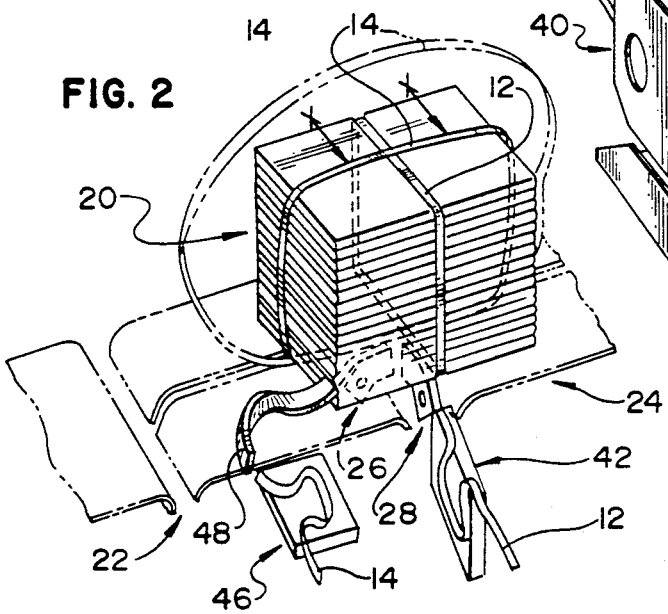
Figure 3:
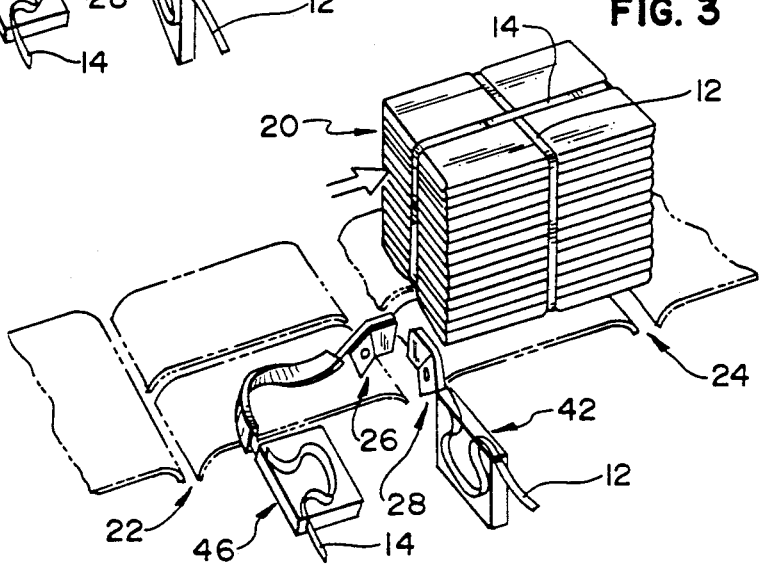

Basic components of a strapping machine 10 constituting a preferred embodiment of this invention are illustrated, in diagrammatic views, in FIGS. 1 through 3. As shown in FIGS. 1 through 3, the strapping machine 10 is used to apply a transverse strap 12 and a longitudinal strap 14 successively around a bundle 20 of newspapers, magazines, or like items. As mentioned above, such items often tend to be somewhat slippery in relation to one another.

The strapping machine 10 comprises conveyors 22 for conveying the bundle 20 into a strapping zone and conveyors 24 for conveying the bundle 20 from the strapping zone. The bundle 20 is shown as approaching the strapping zone in FIG. 1, as being strapped in the strapping zone in FIG. 2, and as leaving the strapping zone in FIG. 3.

The strapping machine 10 comprises a strapping head 26 for applying the transverse strap 12 and a strapping head 28 for applying the longitudinal strap 14. Each of the strapping heads 26, 28, is a strapping head of a known type used in prior newspaper-strapping and other strapping machines available commercially from Signode Packaging Systems (a division of Illinois Tool Works Inc.) of Glenview, Ill. Their structure and their operation, therefore, are known to persons skilled in the art of strapping machines.

Each of the strapping heads 66, 28, performs a series of known functions. The strapping head receives a strap of indefinite length, feeds the strap through a chute, around a bundle, and grips the leading end of the strap. Next, the strapping head tensions the strap so as to form a tensioned loop around the bundle, whereupon the strapping head welds the tensioned loop. Welding is accomplished by a heated blade. After the tensioned loop has been welded, the strapping head serves the welded loop from any excess of the strap.

Each of the strapping heads 26, 28, is designed to apply, among other materials, oriented polypropylene strapping, as exemplified by CONTRAX TM strapping available commercially from Signode Packaging Systems, supra. It is preferred that transverse strap 12 and the longitudinal strap 14 are made from such strapping.

The strapping machine 10 comprises a transverse strap chute 30, as shown in FIG. 1, for receiving the transverse strap 12 to be thus applied, for guiding the transverse strap 12 around the bundle 20 in the strapping zone, and for releasing the transverse strap 12 when it is applied. The strapping machine comprises a longitudinal strap chute 32, as shown in FIG. 1, for receiving the longitudinal strap 14 to be thus applied, for guiding the longitudinal strap 14 around the bundle 20 in the strapping zone, and for releasing the longitudinal strap 14 when it is applied. The transverse strap chute 30 and the longitudinal strap 32 are omitted in FIGS. 2 and 3 so as to show the transverse strap 12 and the longitudinal strap 14.

The strapping machine 10 comprises a strap dispenser 34, which includes a strap accumulator 36, for supplying the transverse strap 12 to the transverse strap chute 30. The strapping machine 10 comprises a strap dispenser 38, which includes a strap accumulator 40, for supplying the longitudinal strap 14 to the longitudinal strap chute 32. The strap dispensers 34, 38, including the strap accumulators 36, 40, are similar to strap dispensers of a known type available commercially from Signode Packaging Systems, supra. Their structure and their operation are known, therefore, to persons skilled in the art of strapping machines.

The strapping machine 10 comprises a strap accumulator 42 between the strap accumulator 36 of the strap dispenser 34 and the strapping head 26 used to apply the transverse strap 12. The transverse strap 12 passes through the strap accumulator 42 when the strapping head 26 feeds the transverse strap 12. The strap accumulator 42 accumulates the excess of the transverse strap 12, when the strapping head 26 tensions the transverse strap 14.

The strapping machine 10 comprises a strap accumulator 46 and a strap chute 48 between the strap accumulator 40 of the strap dispenser 38 and the strapping head 28 used to apply the longitudinal strap 14. The strap chute 48 is disposed between the strap accumulator and the strapping head 28. The longitudinal strap 14 passes through the strap accumulator 46 and is guided by the strap chute 48 when the strapping head 28 feeds the longitudinal strap 14. The strap accumulator 46 accumulates the excess of the longitudinal strap 14, as guided by the strap chute 48, when the strapping head 28 tensions the longitudinal strap 12.

However, according to an important aspect of this invention, the strap chute 48 between the strap accumulator 46 and the strapping head 28 is curved and twisted. It is curved and twisted so as to direct the longitudinal strap 14 along a serpentine path with at least one curve and at least one twist. Because the strap chute 48 is curved and twisted, it is possible to locate the strap dispenser 38, which supplies the longitudinal strap 14, and the strap dispenser 34, which supplies the transverse strap 12, at the same side of the strapping machine 10, as shown. It is not necessary, therefore, to locate the strap dispenser 38 at the front or back of the strapping machine 10 where the strap dispenser 38 would interfere with conveyors or other components.

The transverse strap chute 30 arches from one of the opposite sides of the strapping zone to its other side. Thus, the transverse strap chute 30 does not interfere with the bundle 20 being conveyed into the strapping zone, in which the transverse strap chute 30 straddles the bundle 20.

The longitudinal strap chute 32 arches from one of the opposite ends of the strapping zone to its other end. According to an important aspect of this invention, the longitudinal strap chute 32 is curved and twisted so as to direct the longitudinal strap 14 along a serpentine path with plural curves and plural twists. Specifically, the longitudinal strap chute 32 is curved and twisted so as to be laterally displaced from the strapping zone at each such end of the strapping zone, to the same side of the strapping zone. Thus, as displaced laterally from the strapping zone at each such end of the strapping zone, the longitudinal strap chute 32 avoids interfering with the bundle 20 being conveyed into the strapping zone or from the strapping zone.

Moreover, the strapping machine 10 comprises a pair of deflectors 50, 52, for deflecting the longitudinal strap 14 when the longitudinal strap 14 is released by the longitudinal strap chute 32, so as to center the longitudinal strap 14 onto the bundle 20 present within the strapping zone.

These and other components of the strapping machine 10 are illustrated in greater detail in FIGS. 4 through 21.

Figure 7:
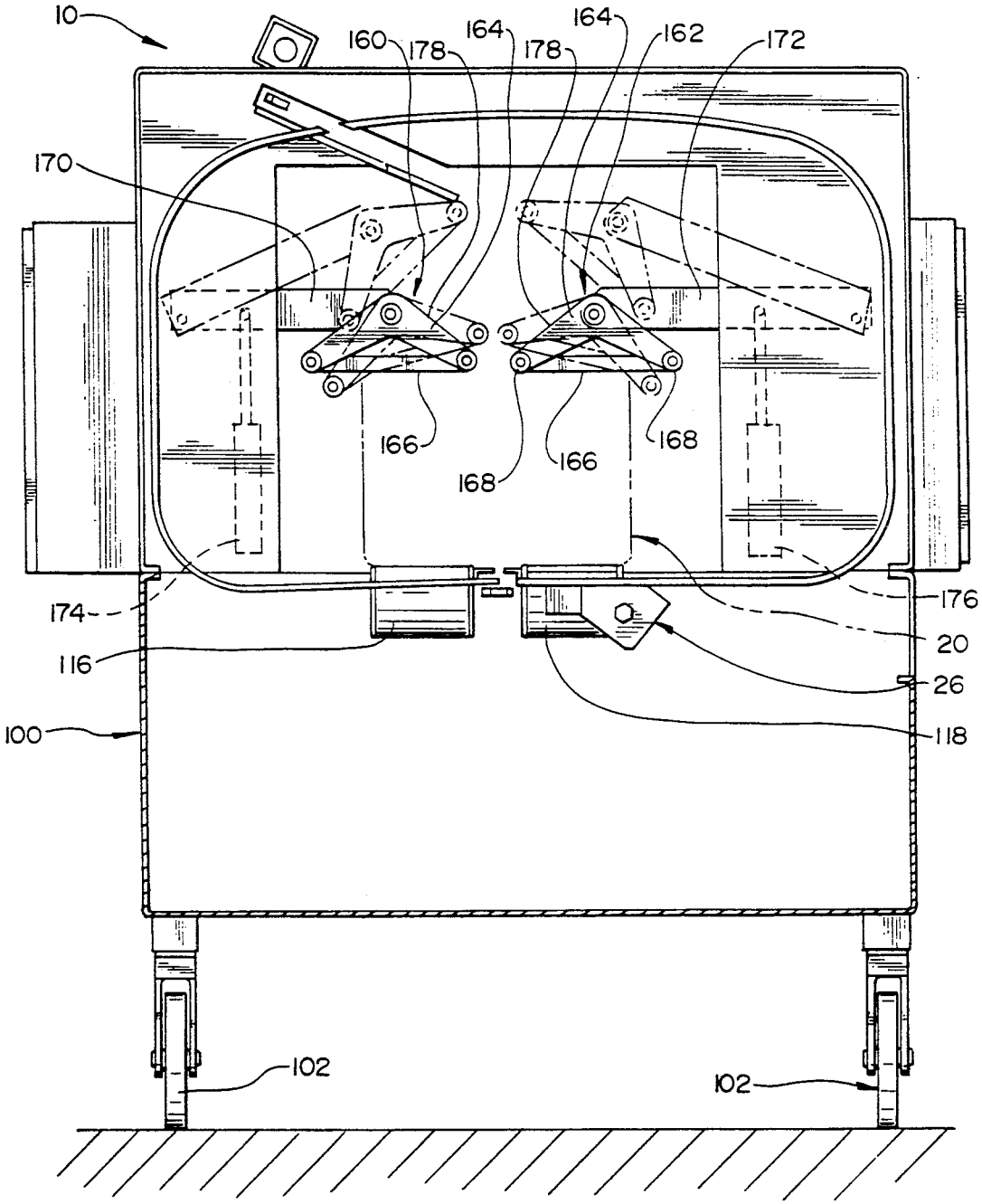
FIG. 7 is a simplified, sectional view taken along line 7—7 of FIG. 6, in a direction indicated by arrows. Various details, many of which are shown in other views, have been omitted.
Figure 8:
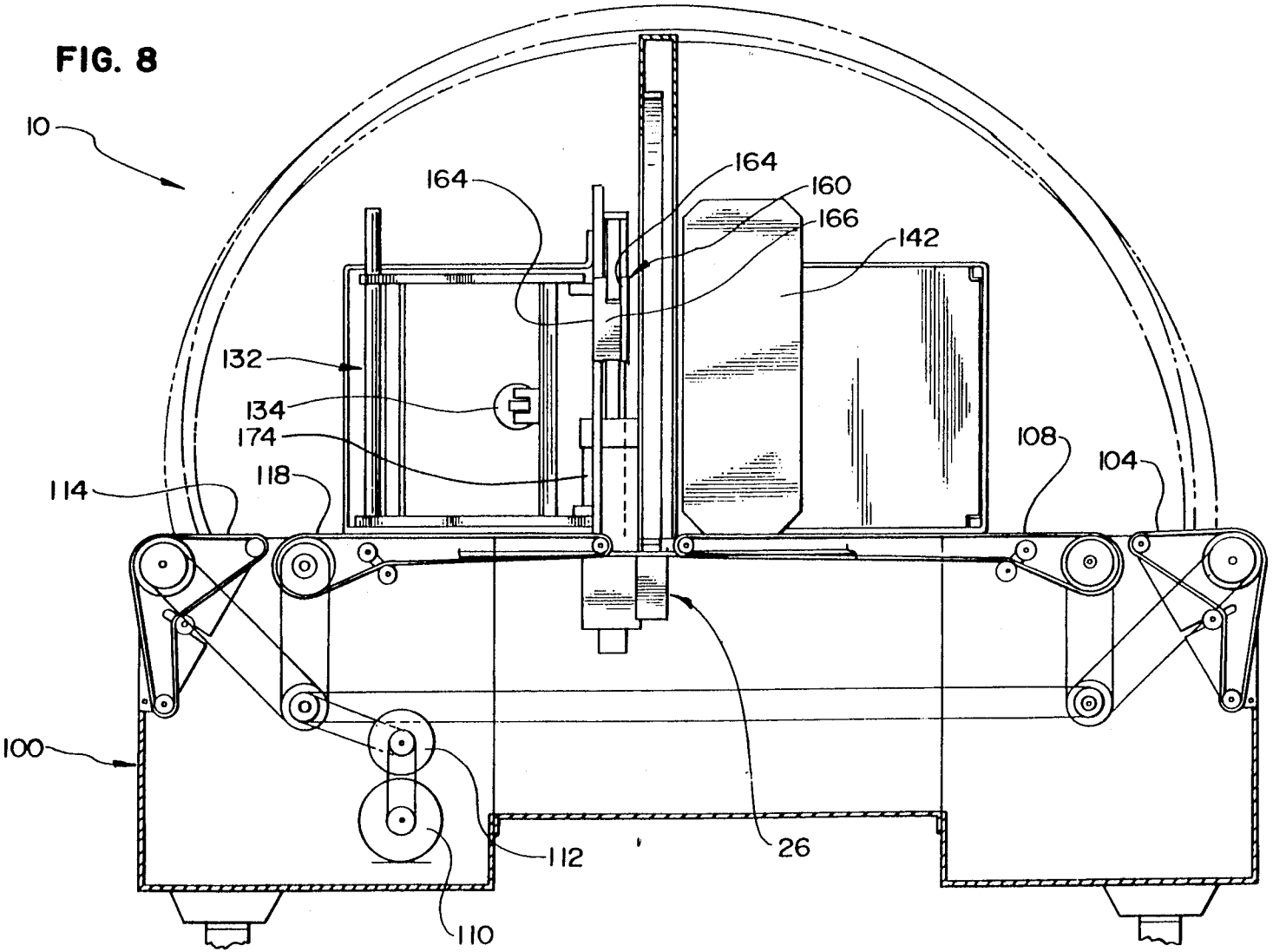
FIG. 8 is a simplified, sectional view taken along line 8—8 of FIG. 6, in a direction indicated by arrows. Various details, many of which are shown in other views, have been omitted.

The strapping machine 10 comprises a base 100, which is supported on casters 102, as shown in FIGS. 1, 7, and 8. The base 100 comprises a supporting framework and sheet metal panels mounted to the supporting framework.

The conveyors 22 for conveying a bundle into the strapping zone, as shown in FIGS. 4 through 8, comprise three separate belt conveyors mounted operatively to the base 100, namely a relatively wide belt conveyor 104 arranged to receive the bundle at an inlet end of the strapping machine 10 and two parallel, spaced-apart, relatively narrow belt conveyors 106, 108, arranged to receive the bundle from the belt conveyor 104. As shown in FIG. 8, the belt conveyors 104, 106, 108, are arranged to be conjointly driven from an electric motor 110, via a clutch 112 and an array of driving belts, arranged in a conventional manner.

The conveyors 24 for conveying a bundle from the strapping zone, as shown in FIGS. 4 through 8, comprise three separate belt conveyors mounted operatively to the base 100, namely a relatively wide belt conveyor 114 arranged to discharge a bundle at an outlet end of the strapping machine 10 and two parallel, spaced-apart, relatively narrow belt conveyors 116, 118, arranged to discharge the bundle onto the belt conveyor 114. The belt conveyors 114, 116, 118, are arranged to be conjointly driven from the electric motor 110, via the clutch 112 and the driving belts noted above.

Figure 4:
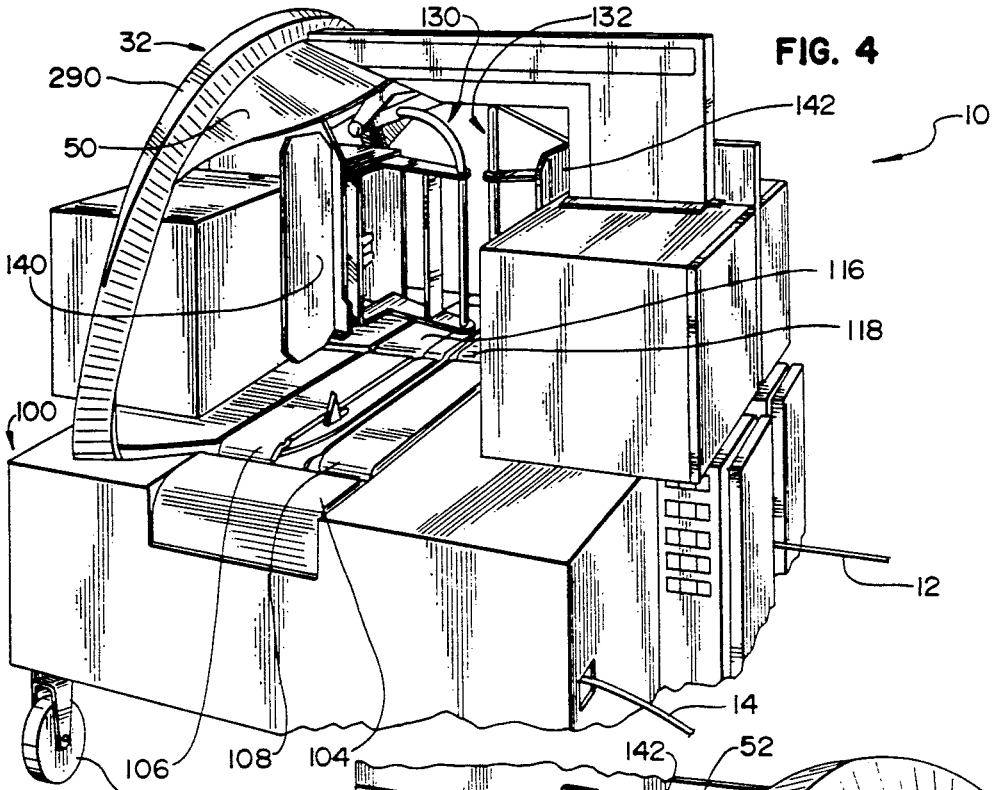
FIG. 4 is a partly fragmentary, perspective view of a strapping machine constituting a preferred embodiment of this invention.
Figure 5:
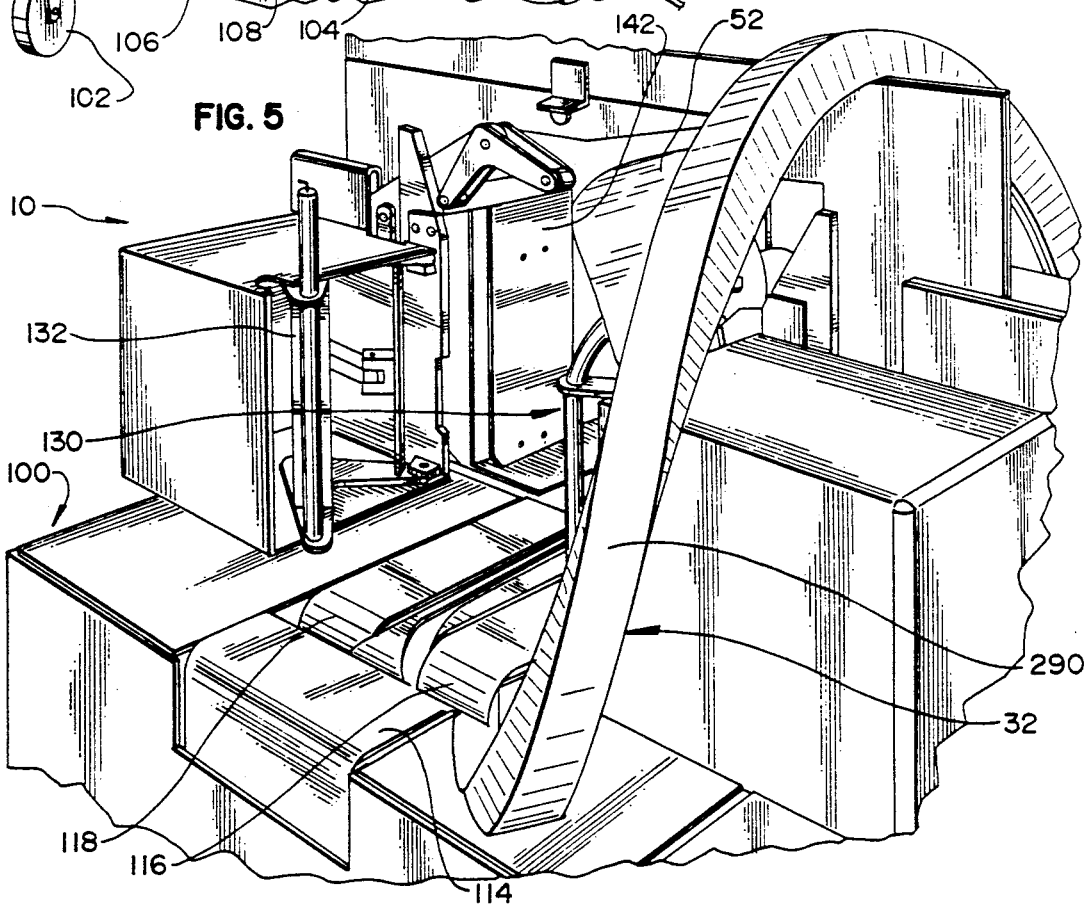
FIG. 5 is a partly fragmentary, perspective view of the strapping machine from a different vantage.
Figure 6:
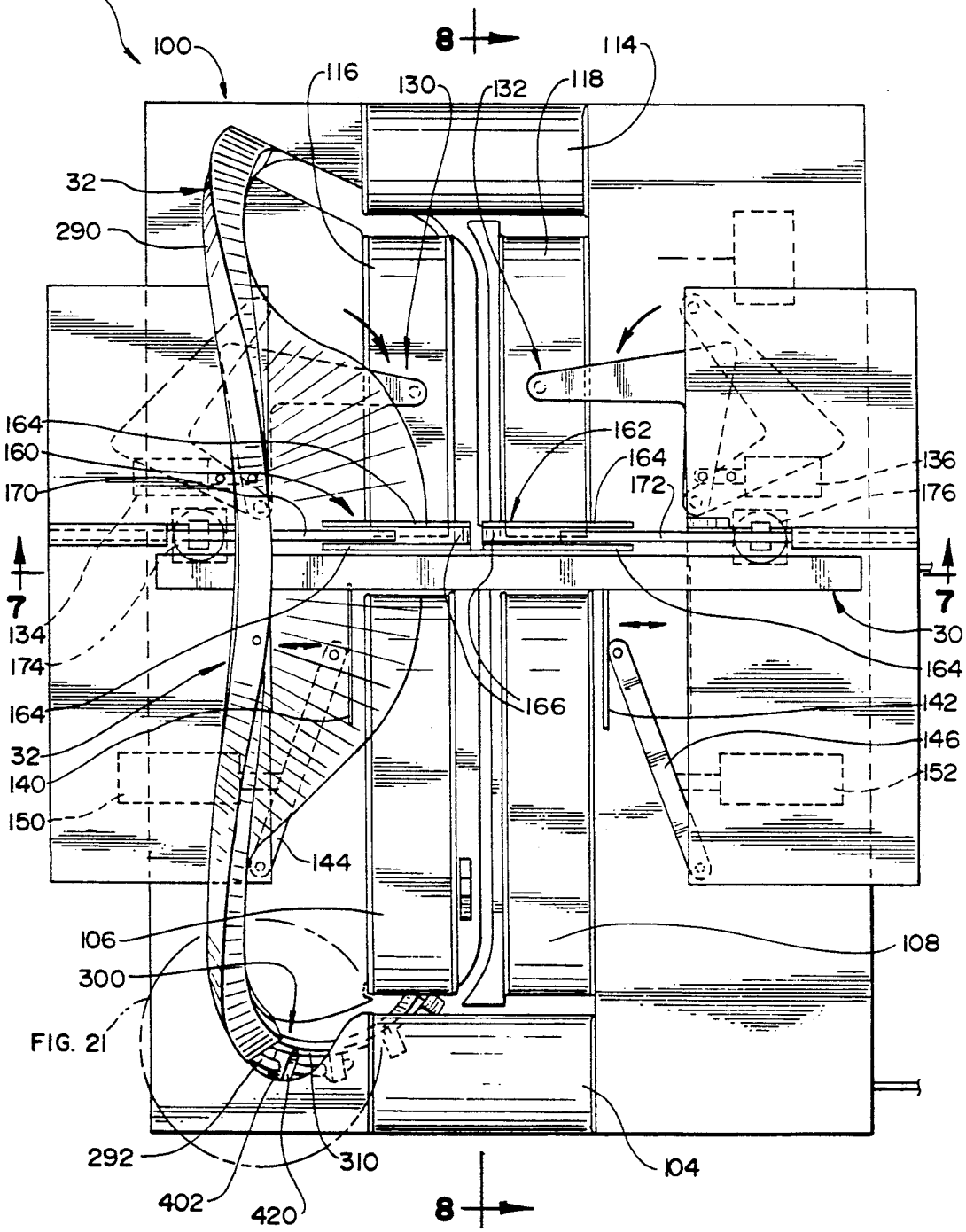
FIG. 6 is an upper plan view of the strapping machine.

The strapping machine 10 comprises, as shown in FIGS. 4, 5, and 6, a pair of swingable gates 130, 132, for arresting a bundle being conveyed into the strapping zone when the bundle has reached a predetermined position in the strapping zone. The gates 130, 132, are swingable about vertical axes, between withdrawn positions and operative positions, as actuated by pneumatic piston-cylinder mechanisms 134, 136, linked to the respective gates 130, 132. In their operative positions, in which they are shown in full lines in FIGS. 4 and 6, the gates 130, 132, do not interfere with a bundle being conveyed from the strapping zone. A pair of slidable stops (not shown) may be alternatively used to arrest the bundle.

The strapping machine 10 comprises, as shown in FIGS. 4, 5, and 6, a pair of bundle-squaring plates 140, 142, for squaring the lateral faces of a bundle in the strapping zone. Each of the bundle-squaring plates 140, 142, is oriented vertically. Each of the bundle-squaring plates 140, 142, is mounted pivotally to the distal end of a plate-mounting link for pivotal movement relative to the plate-mounting link about a vertical axis. The proximate end of the plate-mounting link is mounted pivotally to the base 100 for pivotal movement of the plate-mounting link relative to the base 100 about a vertical axis. As shown in FIG. 6, such a link 144 is used to mount the bundle-squaring plate 140, and such a link 146 is used to mount the bundle-squaring plate 142. A pair of slidable devices (not shown) may be alternatively used to square the lateral faces of the bundle.

Each of the bundle-squaring plates 140, 142, is movable between an operative position in which it is capable of squaring one lateral face of a bundle and a withdrawn position in which it is displaced laterally so as not to interfere with a bundle being conveyed into or from the strapping zone. Each of the bundle-squaring plates 140, 142, is shown in its operative position in full lines in FIG. 6 and in its withdrawn position in phantom lines in FIG. 6. Conjoint movement of the bundle-squaring plates 140, 142, between their withdrawn and operative positions is effected by pneumatic piston-cylinder mechanisms 150, 152, connected operatively to the respective links 144, 146.

The strapping machine 10 comprises, as shown in FIGS. 5, 6, and 7, a pair of bundle-pressing devices 160, 162, for pressing a bundle in the strapping zone. As shown in phantom lines in FIG. 7, the bundle-pressing devices 160, 162, are arranged to press downwardly and laterally on the upper, lateral edges of a bundle, such as the bundle 20. Each of the bundle-pressing devices 160, 162, comprises a pair of brackets 164 having an inverted, shallow V-shape, as shown. Each of the bundle-pressing devices 160, 162, also comprises an endless belt 166 made of synthetic rubber or like material. The endless belt 166 is deployed around a pair of spaced spools 168 (one shown in FIG. 5) carried by the brackets 162.

Each of the bundle-pressing devices 160, 162, is mounted pivotally to the distal end of a device-mounting link for pivotal movement relative to the device-mounting link about a horizontal axis. The proximate end of the device-mounting link is mounted pivotally to the base 100 for pivotal movement relative to the base 100 about a horizontal axis parallel to the horizontal axis mentioned in the preceding sentence. Thus, such a link 170 is used to mount the bundle-pressing device 160, and such a link 172 is used to mount the bundle pressing device 162.

Each of the bundle-pressing devices 160, 162, is movable between an operative position in which it is capable of pressing downwardly on a bundle in the strapping zone and a withdrawn position in which it is elevated so as not to interfere with a bundle being conveyed into or from the strapping zone. Conjoint movement of the bundle-pressing devices 160, 162, between their withdrawn and operative positions is effected by pneumatic piston-cylinder mechanisms 174, 176, connected operatively to the respective links 170, 172.

When each of the bundle-pressing devices 160, 162, is in its operative position, the brackets 164 of the respective devices 160, 162, are spaced from each other so as to permit a longitudinal strap to be downwardly pulled therebetween, toward a bundle pressed by such devices 160, 162, as the longitudinal strap is tensioned. Moreover, the brackets 164 provide sloped surfaces 178, which direct the longitudinal strap between the bundle-pressing devices 160, 162, if such strap is pulled downwardly against one of such surfaces 178 as it is tensioned. Each surface 178 permits the longitudinal strap to be easily pulled downwardly along such surface 178 and to be thus deflected onto a central portion of a bundle, such as the bundle 20, if the strap is pulled downwardly against such surface as it is tensioned.

Figure 16:
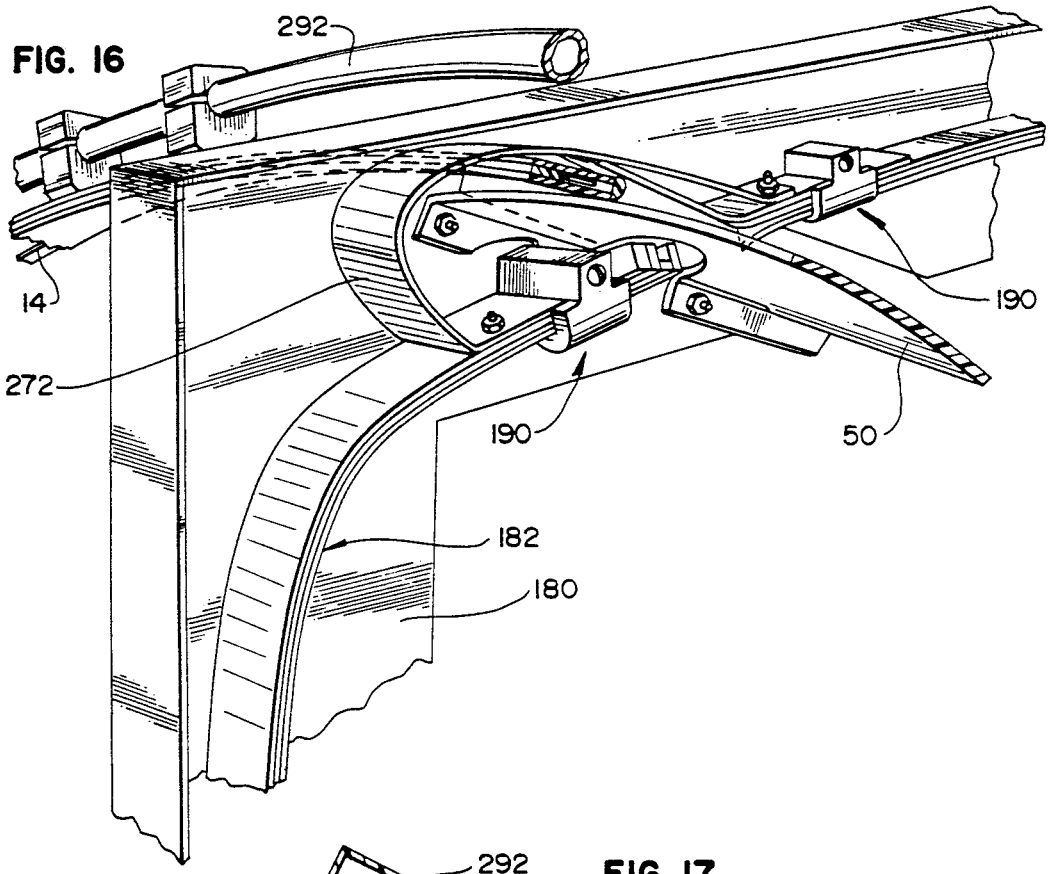
FIG. 16, on a similar scale, is a fragmentary, perspective detail of certain features at an upper strap crossing of the strapping machine.
Figure 17:
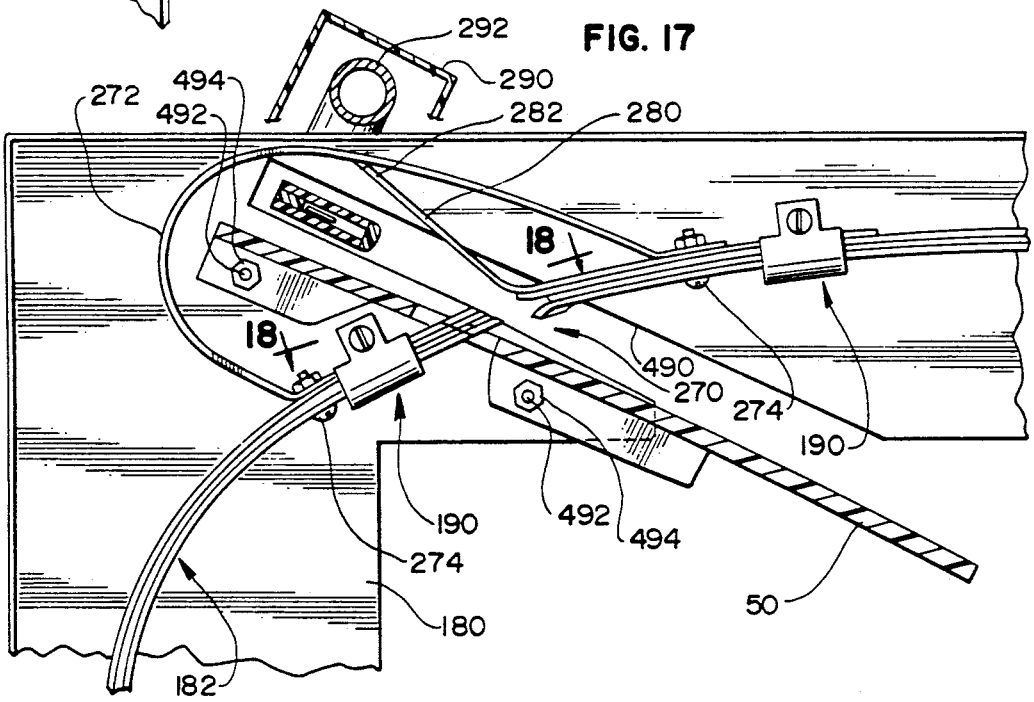
FIG. 17 is an elevational view of those features shown in FIG. 16.

The transverse strap chute 30 of the strapping machine 10 is to be next described in further detail referring to FIGS. 16 and 17. Except as described below, the transverse strap chute 30 is similar to the single strap chutes of prior newspaper-strapping and other strapping machines available commercially from Signode Packaging Systems, supra.

As shown, the transverse strap chute 30 comprises a stationary plate 180, which is oriented vertically, and a channel structure 182. The channel structure 182 is mounted to such plate 180 so as to be horizontally movable toward and away from such plate 180. The channel structure 182 is fabricated from three separate flexible strips of a polymeric material, such as high density polyethylene, namely two wider strips 184 and a narrower strip 186 between the wider strips 184. These separate strips are integrated by spaced rivets (not shown) in a known manner, so as to define a channel 188 bounded by the wider strips 184 on its opposite sides, and by the narrower strip 186 at its inner edge, but open at its outer edge unless closed by the stationary plate 180. A transverse strap, such as the transverse strap 12, may be forwardly pushed through the channel 188, in a known manner, when such strap is fed by the strapping head 26. Such a strap may be backwardly pulled through the channel 188, in a known manner, when the strap is tensioned by the strapping head 26.

Figure 18:
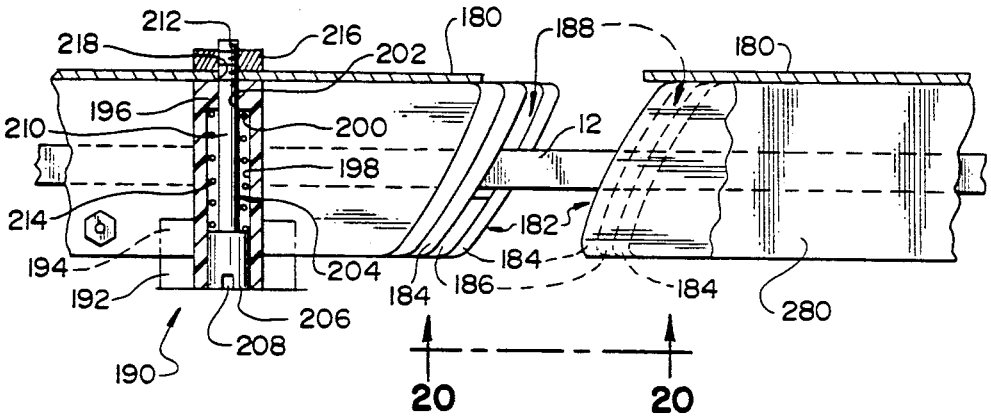
FIG. 18, on a further enlarged scale, is a sectional view taken along line 18—18 of FIG. 17, in a direction indicated by arrows. A length of strapping, which is not shown in FIG. 17, is shown fragmentarily.
Figure 19:
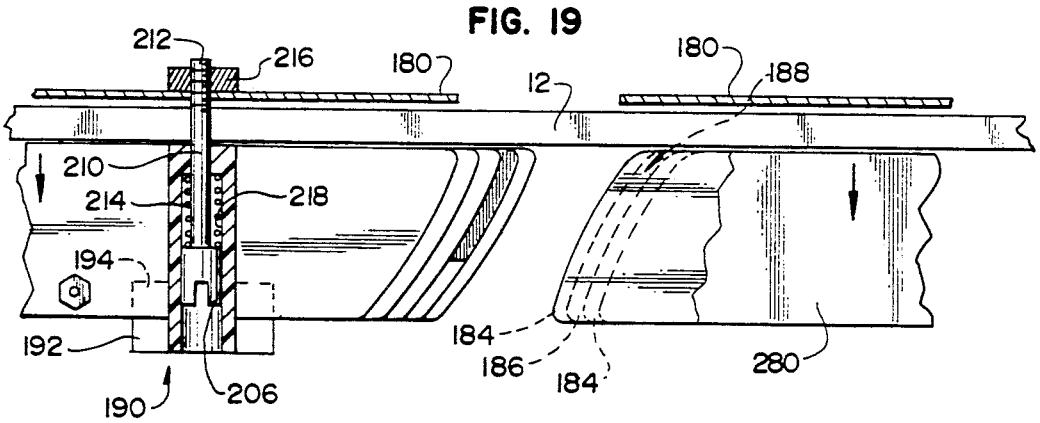
FIG. 19 is a view similar to FIG. 11 but taken at a different stage in operation of the strapping machine.
Figure 20:
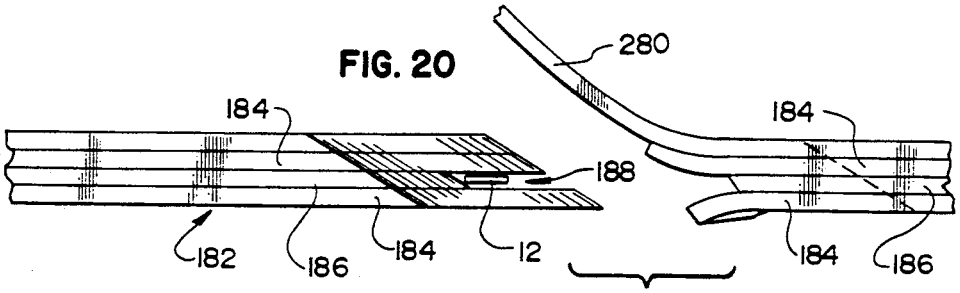
FIG. 20 is a sectional detail take along line 20—20 of FIG. 18, in a direction indicated by arrows.

The channel structure 184 is mounted to the stationary plate 180, at spaced intervals along the channel structure 182, by mounting assemblies 190. Two mounting assemblies 190 are shown in FIGS. 17 and 18. The mounting assemblies 190 bias the channel structure 184 against the stationary plate 180 but permit the channel structure 182 to be horizontally displaced from the stationary plate 180 so as to release a transverse strap, such as the transverse strap 12, when such strap is tensioned by the strapping head 26.

Each mounting assembly 190 comprises a bracket 192, which is molded from a polymeric material, such as high density polyethylene. The bracket 192 includes a hook portion 194, which hooks under one of the strips 184 of the channel structure 182, and a socket portion 196, which overlies the other strip 184. The socket portion 196 has a cylindrical socket 198, which is bounded at its inner end by an annular, inner wall 200 defining an aperture 202.

Each mounting assembly 190 comprises a mounting pin 204 having an enlarged, cylindrical head 206, which has a screwdriver-receiving slot 208, and having an elongate shank 210, which has a threaded end 212. The cylindrical head 206 fits coaxially and slidably into the cylindrical socket 198.

Each mounting assembly 190 comprises a coiled spring 214, which is coiled around the shank 210, so as to bear against the head 206. It also comprises a threaded nut 216, which is threadable onto the threaded end 212.

The bracket 192, the pin 204, the spring 214, and the nut 216 are assembled, as shown, so that the channel structure 182 is bracketed between the hook portion 194 and the socket portion 196. The shank 210 (with the spring 214 coiled around it) is passed through the aperture 202 so that the threaded end 212 extends beyond the aperture 202. An aperture 218 is provided in the stationary plate 180. Where the threaded end 212 extends beyond the aperture 202, the threaded end 212 extends through the aperture 218 and receives the nut 216, which is threaded onto the threaded end 212.

The spring 214 bears against the head 206 of the pin 204 and against the wall 200 of the bracket 192 so as to bias the channel structure 182, which is engaged by the hook portion 194 of the bracket 192, against the stationary plate 180. The spring 214 may be axially compressed, however, as to permit the channel structure 184 to be horizontally displaced from the stationary plate 180. When a transverse strap, such as the transverse strap 12, is tensioned by the strapping head 26, such strap causes the channel structure 182 to be sufficiently displaced from the stationary plate 180 for the transverse strap chute 30 to release the strap.

As shown in FIGS. 11 through 15, a channel member 220, which may be an aluminum extrusion, defines a channel 222. The channel member 220 is attached to one end portion the channel structure 182, by a bracket 224 with screws 226 and coacting nuts 228 attaching the bracket 224 to the inlet channel member 220 and to the end portion of the channel structure 182, so that the channel 188 and the channel 222 communicate with each other. The bracket 224, which is U-shaped when viewed endwise, has two planar portions 230, each having a U-shaped notch 232, and a cross-portion 234 connecting the planar portions 230. The channel member 220 is movable toward and away from the stationary plate 180.

As attached by the bracket 224, the inlet channel member 220 and the inlet end portion 222 of the channel structure 184 are spaced from each other so as to provide sufficient clearance for a strap-stripping pin 236, which is fixed to the base 100. A solenoid 240 is linked to the inlet channel member 220, via a block 242, so as to control movement of the inlet channel member 220 toward and away from the stationary plate 180. The block 242 is biased, by a spring 224 coacting with a stud 246 mounted to the stationary plate 180, so as to displace the inlet channel member 220 away from the stationary plate 180. The solenoid 240 is actuatable so as to drive the inlet channel member 220 against the stationary plate 180 when such a strap is fed therethrough.

Because the channel member 220 is displaced from the stationary plate 180 when a transverse strap is tensioned by the strapping head 26, the strap can be easily stripped from the transverse strap chute 30. The channel structure 182 is displaced from the stationary plate 180 in a localized region that moves progressively along the transverse strap chute 30 as such a strap is stripped therefrom.

Figure 11:
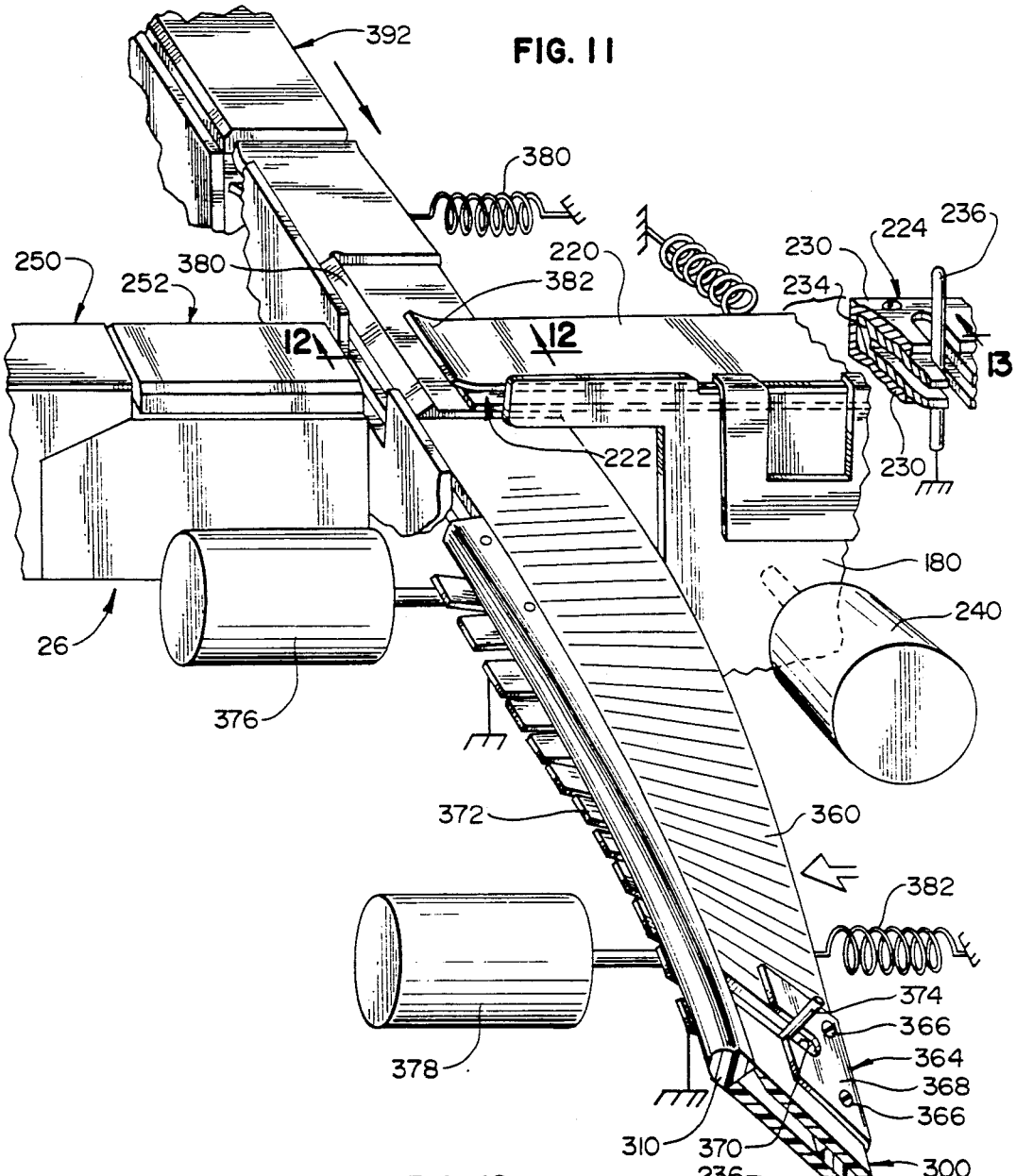
FIG. 11, on a slightly smaller scale, is a fragmentary, perspective detail of certain features at a lower strap crossing of the strapping machine.
Figure 13:
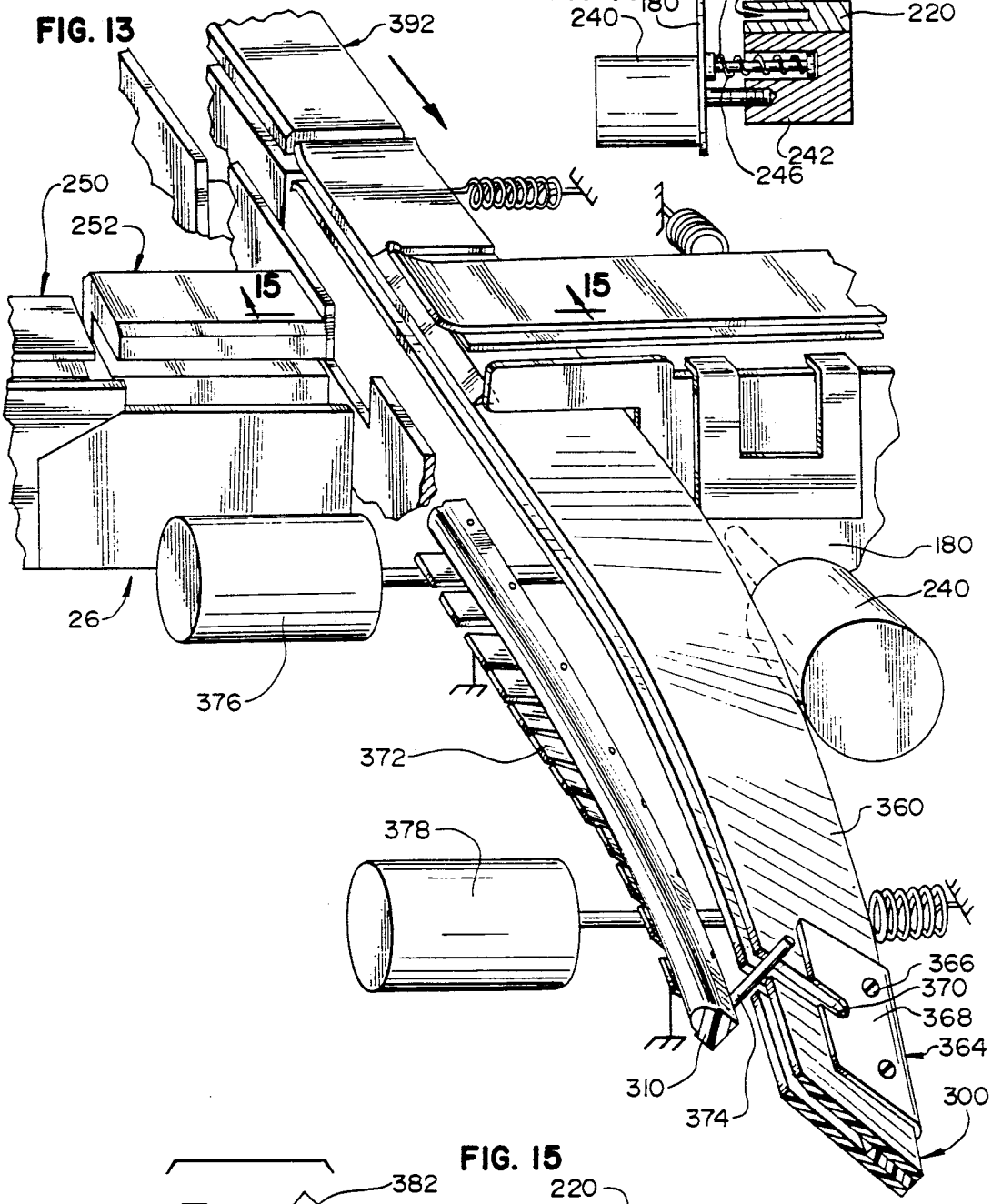
FIG. 13 is a view similar to FIG. 11 but taken at a different stage in the operation of the strapping machine.
Figure 14:
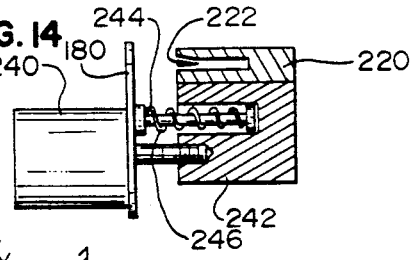
FIG. 14 is a fragmentary, partly cross-sectional detail of certain features shown in FIG. 12.

As shown in FIGS. 11 and 13, the strapping head 26, as a known feature, has a re-entry chute assembly 250, to which the opposite end portion of the channel structure 182 is attached, in a known manner. The stationary plate 180 is attached to a stationary part of the strapping head 26. Also, a known feature, the strapping head 26 has a welding anvil 252 adjacent to the re-entry chute assembly 250. The strapping head 26, via the re-entry chute assembly 250, controls movement of the channel structure 182 toward and away from the stationary plate 180 where the channel structure 182 is attached to the re-entry chute assembly 250, in a known manner. Thus, when a strap is being stripped from the transverse strap chute 30, the channel member 250 is moved away from the stationary plate 180 where the channel structure 182 is attached to the re-entry chute assembly 250. The welding anvil 252 (within which the strap is welded, in a known manner, into a tensioned loop) is displaced by the strapping head 26, in a known manner, so as to release the strap after it has been welded.

As shown in FIGS. 16 and 17, the transverse strap chute 30 is arranged to permit a longitudinal strap, such as the longitudinal strap 14, to cross the transverse strap chute 30 when such strap is released by the longitudinal strap chute 32 as the strap is tensioned by the strapping head 28. Thus, the channel structure 182 is interrupted so as to produce a gap 270, through which a longitudinal strap can pass. A transverse strap, such as the transverse strap 12, has sufficient stiffness to cross the gap 270 without jamming when fed by the strapping head 26.

A bridging member 272, which is made from a rigid metal band, is attached by screws 274 and coacting nuts 276 to the channel structure 182, at the opposite sides of the gap 270. One of the screws 274 and the nut 276 coacting therewith are used also to attach a strap-deflecting member 280, which is welded at one end 282 to the bridging member 272. The longitudinal strap chute 32 is arranged, in a manner to be later described, so that a longitudinal strap passes beneath the bridging member 272 when such strap is fed by the strapping head 28. Thus, when a longitudinal strap is released by the longitudinal strap chute 32 as such strap is tensioned by the strapping head 28, the strap crosses the transverse strap chute 30 by passing through the gap 270.

Figures 21, 22:
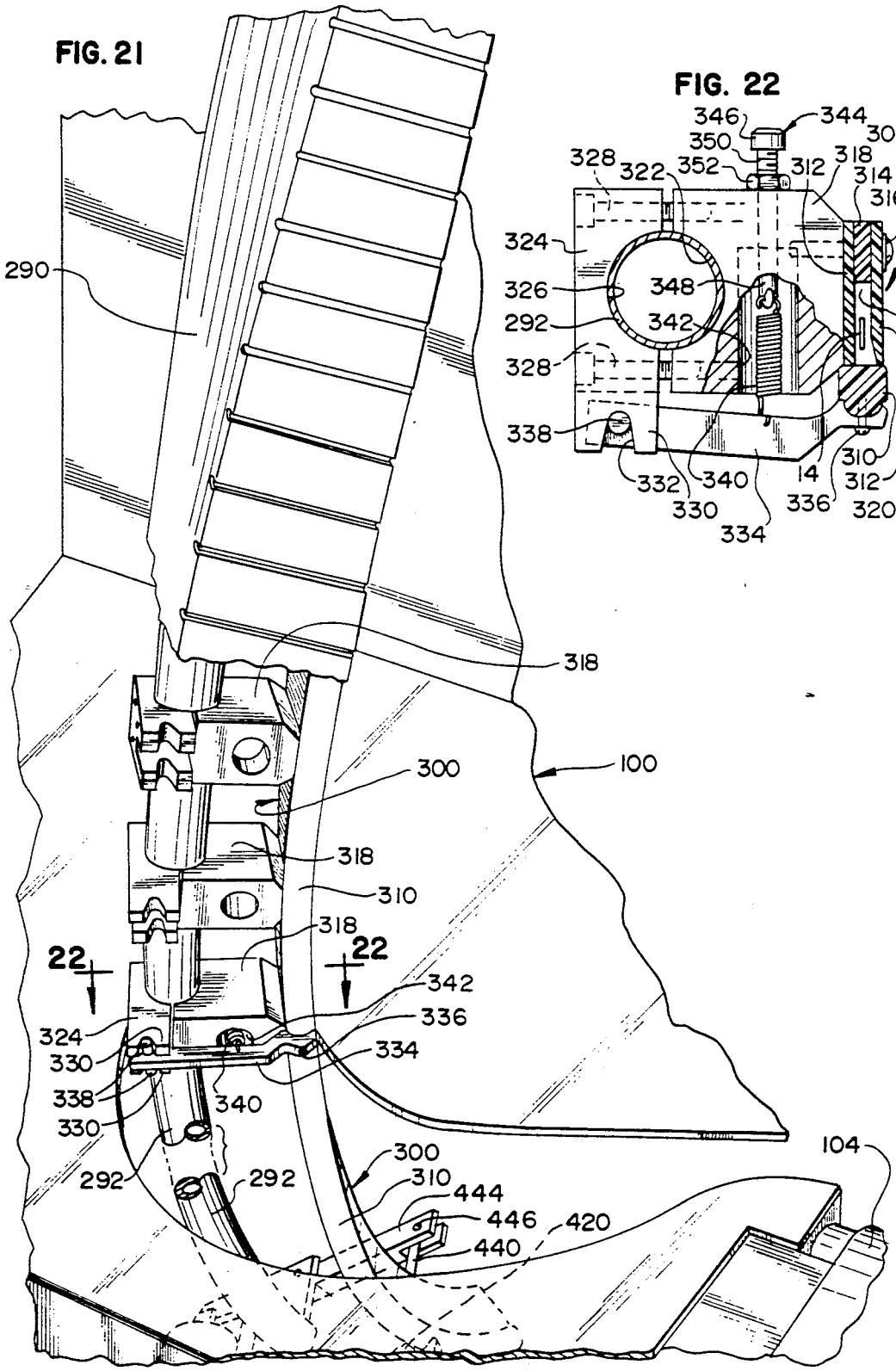
FIG. 21 is a fragmentary, perspective view of certain features of a serpentine strap chute of the strapping machine, as shown on a smaller scale and outlined by a phantom circle in FIG. 6.
FIG. 22 is a sectional view taken along line 22—22 of FIG. 21, in a direction indicated by arrows, to show a chute-mounting assembly.

The longitudinal strap chute 32 is to be next described in further detail. As shown in FIGS. 4 through 6, in FIG. 21, and elsewhere in the drawings, the longitudinal strap chute 32 comprises a protective shroud 290, which is made from a polymeric material, such as poly(-vinyl chloride). As shown in FIGS. 21 and elsewhere in the drawings, the longitudinal strap chute 32 is supported where it arches over the strapping zone, between the opposite ends of the strapping zone, by a supporting pipe 292, which is mounted at its opposite ends rigidly to the base 100. The supporting pipe 292 and such portions of the longitudinal strap chute 32 as are supported by the supporting pipe 292 are covered on three sides by the protective shroud 290.

The longitudinal strap chute 32, as shown in FIGS. 21 through 25, comprises a channel structure 300 and a closure member 310. The channel structure 300 and the closure member 310 respectively are mounted, as described below, for relative movement with respect to each other.

The channel structure 300 is fabricated from three separate flexible strips of a polymeric material, such as high density polyethylene, namely two wider strips 312 and a narrower strip 314 between the wider strips 312. The separate strips are integrated with one another along the supporting pipe 292, except as described below, by screws 316 (one shown in FIG. 22) mounting the channel structure 300 to spaced mounting blocks 318 made of a similar material. The integrated strips define a channel 320 bounded by the wider strips 312 on its opposite sides, and by the narrower strip 314 at its inner edge, but open at its outer edge except when closed by the closure member 310. A longitudinal strap, such as the longitudinal strap 14, may be forwardly pushed through the channel 320 when such strap is fed by the strapping head 28. Such a strap may be backwardly pulled through the channel 320 when the strap is tensioned by the strapping head 28.

Each mounting block 318 has a semi-cylindrical depression 322 conforming to and engaging the supporting pipe 290. Each mounting block 318 is clamped to the supporting pipe 292 by a clamping member 324 having a similar depression 292 conforming to and engaging the supporting pipe 292 and being fastened to such mounting block 318 by screws 328 on opposite sides of the supporting pipe 290. Each clamping member 324 has two spaced flanges 330, each having a notch 332 opening laterally, as shown.

The closure member 310, which is flexible, is extruded from a polymeric material, such as high density polyethylene. The closure member 310 is mounted pivotally to selected ones of the clamping members 324, e.g., to every third one of the clamping members 324. The closure member 310 is mounted pivotally to each selected member 324, as shown in FIGS. 21 and 22, by a pivot arm 334 fastened at its distal end to the closure member 310 by a screw 336 and mounted pivotally to such selected member 324 by pivot pins 338 extending oppositely from the proximal end of the pivot arm 332 into the notches 332 of the spaced flanges 330 of such selected members 324.

Figure 23:
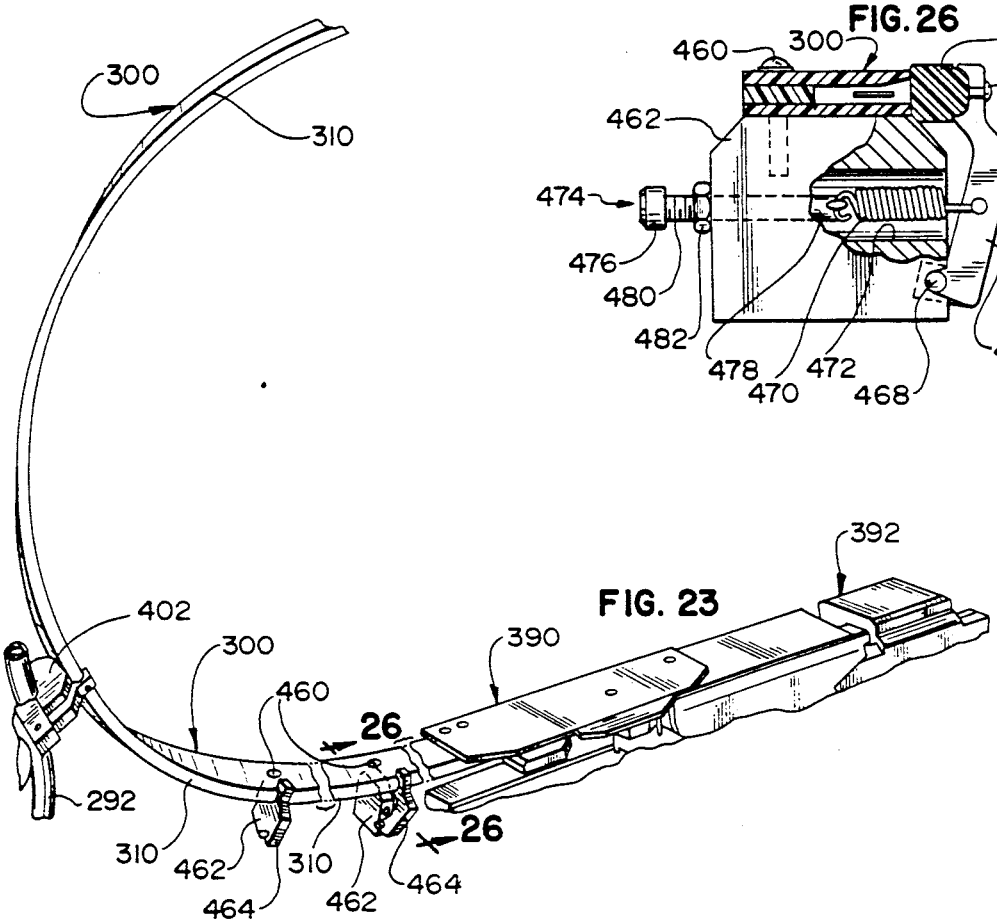
FIG. 23, on a smaller scale, is a fragmentary, perspective view of further features of the serpentine strap chute of FIG. 19.

A tensioning spring 340 is used to bias the pivot arm 334 so as to bias the closure member 310 against the channel structure 300, thereby to close the channel 320, as shown in FIG. 23. The tensioning spring 340 is deployed within a socket 342 in the mounting block 318 associated with such selected member 324. The tensioning spring 340 is fastened at a first end to the pivot arm 334, between the closure member 310 and the pivot pin 338, and at a second end to an adjusting stud 344. The adjusting stud 344 has a head 346 and a shank 348 with a threaded portion 350 adjacent to the head 346. A threaded nut 352 is threaded onto the threaded portion 350 before the shank 348 is inserted through an aperture in the associated block 318. The threaded nut 352 bears against the associated block 318, at a margin of the aperture receiving the shank 348, and is adjustable along the threaded portion 350 so as to adjust the tension applied by the tensioning spring 340 to the pivot arm 334.

As shown in FIGS. 11, 12, 13, and 15, a channel member 360, which is an aluminum extrusion, defines a channel 362. The channel member 360 is attached to one end portion of the channel structure 300, by a bracket 364 with screws 366 and coacting nuts (not shown) attaching the bracket 364 to the inlet channel member 360 and to the end portion of the channel structure 300, so that the channel 320 and the channel 362 communicate with each other. As shown, the channel member 360 has a slight curve and a slight twist. The bracket 362 has two planar portions 368 (one shown in FIG. 11 and 13) each having a U-shaped notch 370. Where the closure member 310 confronts the inlet channel member 360, the closure member 310 is stiffened, by a notched metal strip 372, and also fixed to the base 100.

As attached by the bracket 364, the channel member 360 and the inlet end portion 362 of the channel structure are spaced from each other so as to provide sufficient clearance for a strap-stripping pin 374, which is fixed to the base 100. Two solenoids 376, 378 are linked to the inlet channel member 360 so as to control movement of the inlet channel member 360 toward and away from the closure member 310 where the closure member 310 is fixed to the base 100. The inlet channel member 300 is biased by two springs 380, 382, so as to displace the inlet channel member 300 away from the closure member 252 except when the solenoids 376, 378, are actuated. The solenoids 376, 378 are actuatable so as to drive the inlet channel member 300 against the closure member 310 when a longitudinal strap, such as the longitudinal strap 14, is fed through the longitudinal strap chute 32.

Figure 12:
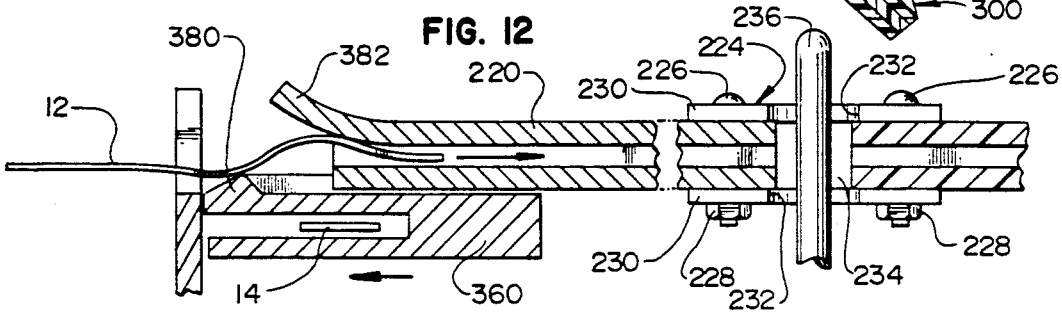
FIG. 12, on an enlarged scale, is a fragmentary sectional detail taken along line 12—12 of FIG. 11, in a direction indicated by arrows.
Figure 15:
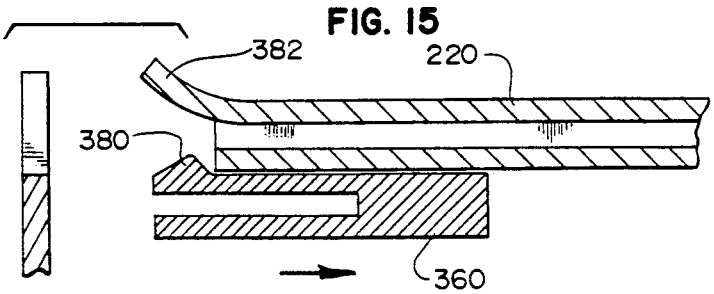
FIG. 15 is a fragmentary, sectional detail taken along line 15—15 of FIG. 13, in a direction indicated by arrows.

As shown in FIGS. 12 and 15, the channel member 360 is formed with an upper, longitudinal rib 380. Moreover, the channel member 220 has a flared, upper lip 382. The rib 380 is arranged to deflect a transverse strap, such as the transverse strap 12, against the lip 382, which deflects such strap into the channel member 220, when the strap is fed by the strapping head 26. However, the channel member 220 is spaced from the welding anvil 252 and adjacent components of the strapping head 26, as shown, by a sufficient distance to permit a longitudinal strap, such as the longitudinal strap 14, to pass between the channel member 220 and the strapping head 26 when tensioned by the strapping head 28.

As shown in FIG. 23, the strapping head 28, as a known feature, has a re-entry chute assembly 390, to which the opposite end portion of the channel structure 300 is attached, in a manner similar to the manner wherein the channel structure 182 is attached to the re-entry chute assembly 250 of the strapping head 26. Also, as a known feature, the strapping head 28 has a welding anvil 392 adjacent to the re-entry chute assembly 390. The welding anvil 392 is shown in FIGS. 11 and 13. The closure member 310 is fixed at its adjacent end of the strapping head 28. The strapping head 28, via the re-entry chute assembly 390, controls movement of the channel member 300 toward and away from the closure member 310 (which is stationary where attached at its adjacent end) where the channel structure 300 is attached to the re-entry chute assembly 390, in a manner similar to the manner wherein the strapping head controls movement of the channel structure 182 where attached to the re-entry chute assembly 250. The welding anvil 392 (within which the strap is welded, in a known manner, into a tensioned loop) is displaced by the strapping head 28, in a known manner, so as to release the strap after it has been welded.

It may be here noted that the channel structure 300 is movable at its opposite ends, where it is attached to the channel member 360 and where it is attached to the re-entry chute assembly 390, but stationary therebetween, where it is attached to the mounting blocks 318. It may be also noted that the closure member 310 is stationary at its opposite ends, where it is fixed to the base 100 and where it is fixed to the strapping head 28. Because the channel structure 300 and the closure member 310 are flexible, there are two transitional regions where both the channel structure 300 and the closure member 310 are movable, namely a transitional region between the channel member 360 and the mounting blocks 318 and a transitional region between the mounting blocks 318 and the re-entry chute assembly 390. In the transitional region between the channel member 360 and the mounting blocks 318, it is sufficient to allow sufficient room for relative movement of the channel structure 300 and the closure member 310, neither being fixed to other structures in such region. In the transitional region between the mounting blocks 318 and the re-entry chute assembly 390, it is necessary to mount the channel structure 300 and the closure member 310 by two different forms of mounting assemblies, as shown in FIGS. 23 through 26.

As shown in FIGS. 21, 23, 24, and 25, at an endmost point of attachment to the supporting pipe 292, the channel structure 300 is mounted by a screw 400 to a mounting block 402. The mounting block 402, which is similar to each mounting block 318, has a semi-cylindrical depression 404 conforming to and engaging the supporting pipe 292 The mounting block 402 is clamped to the supporting pipe 292 by a clamping member 406 having a similar depression 408 conforming to and engaging the supporting pipe 292 and being fastened to the mounting block 402 by screws 410 on opposite sides of the supporting pipe 292. The clamping member 406 has two spaced flanges 412 (one shown) each having a notch 414.

Figure 24:
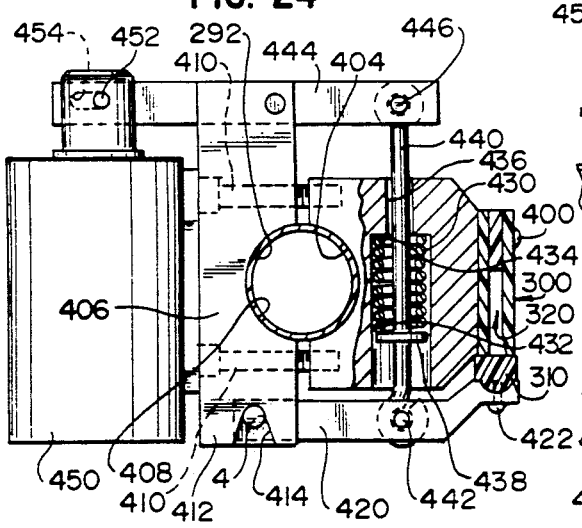
FIG. 24 is a partly sectional view showing a different form of a chute-mounting assembly in a closed condition.
Figure 25:
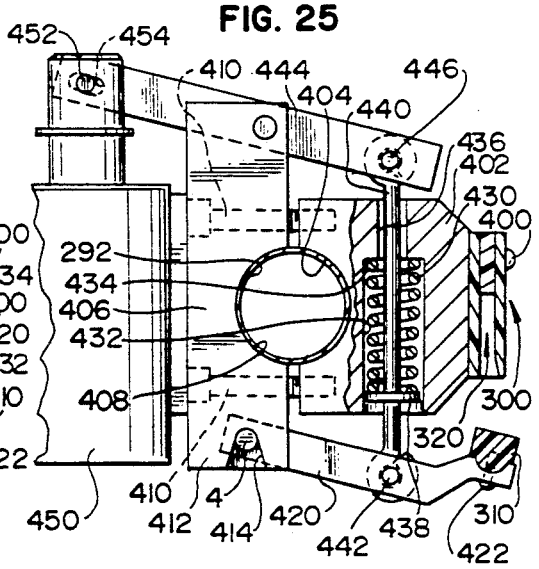
FIG. 25 is a similar view showing the chute-mounting assembly of FIG. 24 in an opened condition.

The closure member 310 is mounted pivotally to the clamping member 406, as shown in FIGS. 24 and 25, by a pivot arm 420 fastened at its distal end to the closure member 310 by a screw 422 and mounted pivotally to the clamping member 406, by pivot pins 424, at the distal end of the pivot arm 420. The pivot pins 424 coact with the notches 414 in the flanges 412. The pivot arm 420 is similar to each pivot arm 334 and is mounted similarly.

A compression spring 430 is used to bias the pivot arm 420 so as to bias the closure member 310 away from the channel structure 300, thereby to open the channel 320, as shown in FIG. 25. The compression spring 430 is deployed within a socket 432 in the mounting block 402 so as to bear against an annular wall 434 of the socket 432, at a margin of an aperture 436 in the mounting block 402, and against an annular member 438 fixed on an elongate link 440 passing through the aperture 436 and through the compression spring 430. The elongate link 440 is linked at its end nearer to the annular member 438 to the pivot arm 420, by a pivot pin 442, between the closure member 310 and the pivot pins 424. The elongate link 440 is linked at its opposite end to a given end of a rocker arm 444 by a pivot pin 446.

A solenoid 450 is mounted fixedly to the clamping member 406. The solenoid 450 is linked to the other end of the rocker arm 444 by a pivot pin 452 coacting with an elongate slot 454 in the rocker arm 444. The rocker arm 444 is mounted pivotally to the clamping member 406, by a pivot pin 456, between the opposite ends of the rocker arm 444. Thus, when the solenoid 450 is deactuated, the compression spring 430 acts on the pivot arm 420, via the elongate link 440, so as to move the closure member 310 away from the channel structure 300, thereby to open the channel 320. Also, when the solenoid 450 is actuated, it acts on the pivot arm 420, via the rocker arm 444 and the elongate link 440, so as to move the closure member 310 toward the channel structure 300, thereby to close the channel 320. The solenoid 450 is actuated when a strap is fed through the channel 320 and is deactuated when the strap is tensioned.

Figure 26:
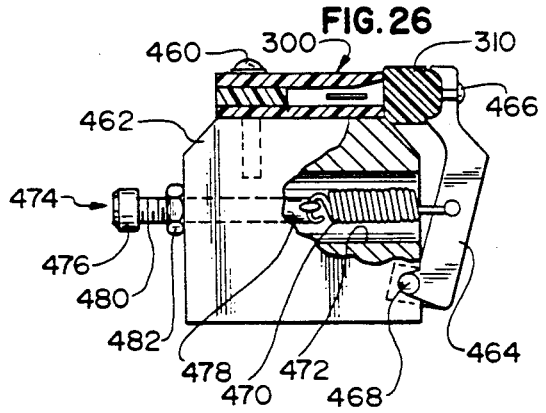
FIG. 26, on an enlarged scale, is a sectional view taken along line 26—26 of FIG. 25, in a direction indicated by arrows, to show yet another form of a chute-mounting assembly.

As shown in FIGS. 23 and 26, at each of two points of attachment between the mounting block 402 and the re-entry chute assembly 390, the channel structure 300 is mounted by a screw 460 to a mounting block 462. The mounting block 462 differs from each mounting block 318, and from the mounting block 402, in that the mounting block 462 is not clamped to the supporting pipe 290.

Rather, the closure member 310 is mounted pivotally to the mounting block 462, as shown in FIGS. 24 and 25, by a pivot arm 464 fastened by a screw at its distal end to the closure member 310 and mounted pivotally to the mounting block 462, by a pivot pin 468, at the distal end of the pivot arm 464. The pivot arm 464 is shorter than each pivot arm 334 and, therefore, is shorter than the pivot arm 420.

A tensioning spring 470 is used to bias the pivot arm 464 so as to bias the closure member 310 against the channel structure 300, thereby to close the channel 320, as shown in FIG. 26. The tensioning spring 470 is deployed within a socket 472 in the mounting block 402 and is fastened at a first end to the pivot arm 464, between the closure member 310 and the pivot arm 464 and at a second end to an adjusting stud 474. The adjusting stud 474 has a head 476 and a shank 478 with a threaded portion 480 adjacent to the head 476. A threaded nut 482 is threaded onto the threaded portion 480 before the shank 478 is inserted through an aperture in the mounting block 462. The threaded nut 482 bears against the mounting block 462, at a margin of the aperture receiving the shank 478, and is adjustable along the threaded portion 480 so as to adjust the tension applied by the tensioning spring 470 to the pivot arm 464.

As mentioned above, the transverse strap chute 30 is arranged to permit a longitudinal strap, such as the longitudinal strap 14, to cross the transverse strap chute 30, through the gap 270, when such strap is released by the longitudinal strap chute 32 as the strap is tensioned by the strapping head 28. As shown in FIGS. 16 and 17, the supporting pipe 292 arches over the stationary plate 180. Also, the channel structure 300 and the closure member 310 pass through a wide slot 490 in the stationary plate 180. The wide slot 490 is directed downwardly and laterally, as shown, and is open at its lower end, as shown, so as to permit the longitudinal strap, after it has been stripped from the longitudinal strap chute 32, to pass downwardly toward a bundle in the strapping zone. The deflecting member 280 deflects the strap so as to prevent it from snagging on the channel structure 182 of the transverse strap chute 30.

The deflectors 50, 52, are mounted by screws 492 and coacting nuts 494 respectively on opposite sides of the stationary plate 180, beneath the wide slot 490. Each of the deflectors 50, 52, is a curved sheet of a polymeric material, such as polycarbonate, as curved so as to center a longitudinal strap, such as the longitudinal strap 14, within the strapping zone as such strap is stripped from the longitudinal strap chute 32.

Figure 9:
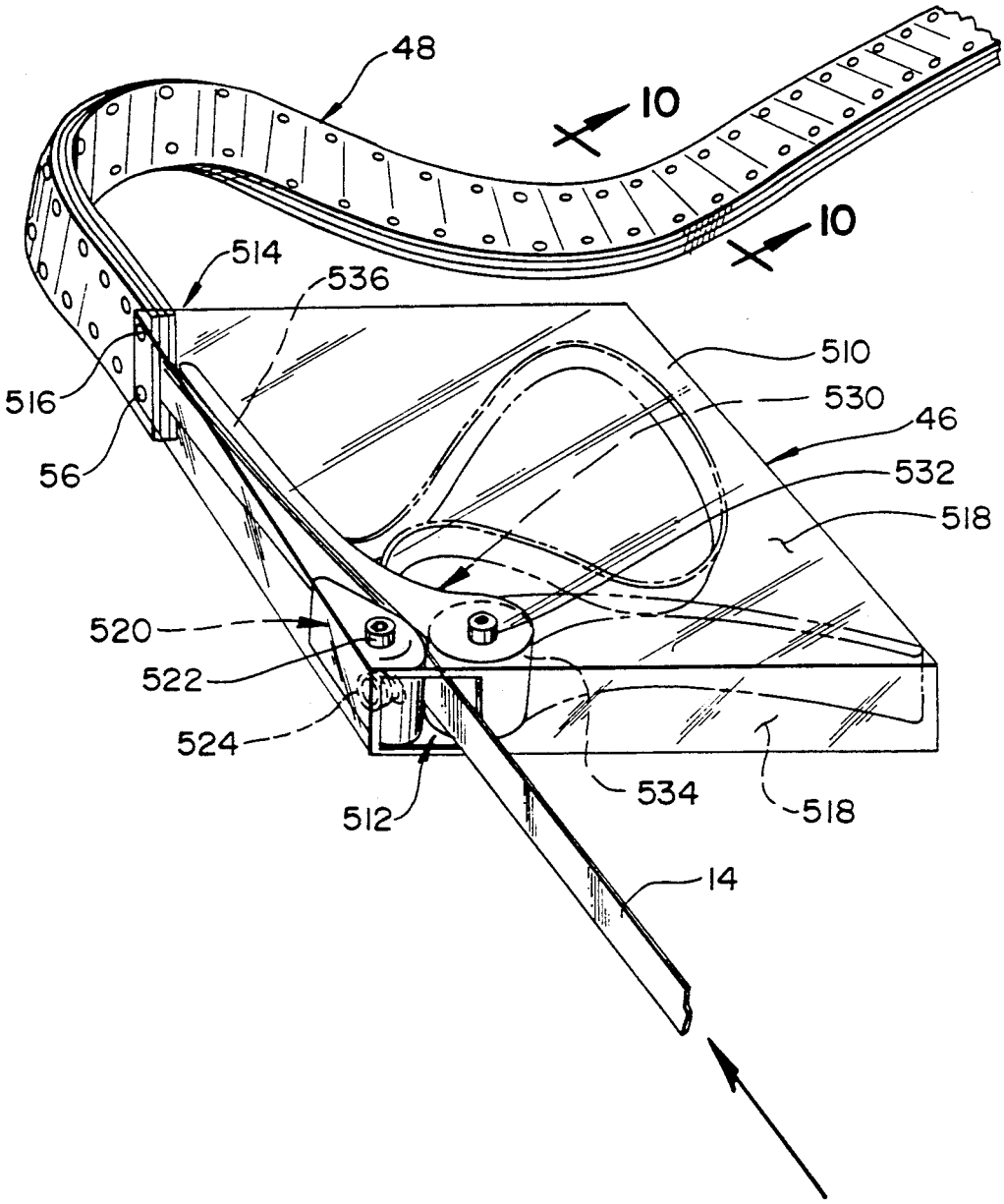
FIG. 9, on an enlarged scale, is a fragmentary, perspective detail of certain features at a strap inlet of the strapping machine.
Figure 10:
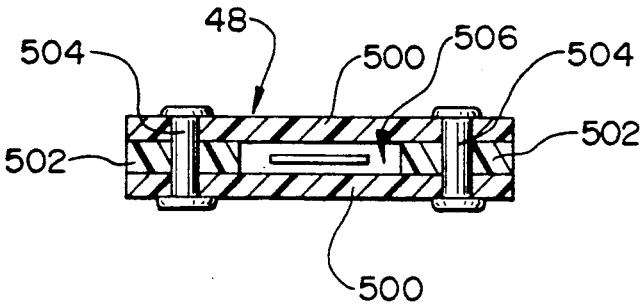
FIG. 10, on a further enlarged scale, is a sectional detail taken along line 10—10 of FIG. 9, in a direction indicated by arrows.

As mentioned above, the strap chute 48 between the strap accumulator 46 and the strapping head 28 is curved and twisted so as to direct a longitudinal strap, such as the longitudinal strap 14, along a serpentine path, with at least one curve and at least one twist. As shown in FIGS. 9 and 10, the strap chute 48 is fabricated from two wide strips 500 of a polymeric material, such as high density polyethylene, and two narrow strips 502 of a similar material. These wide and narrow strips are assembled, by two rows of spaced rivets 504, so as to define an internal channel 506 accommodating a longitudinal strap, such as the longitudinal strap 14.

As shown in FIG. 9, the strap accumulator 46 comprises a rectangular box 510 of transparent polymeric material, such as polycarbonate, with an inlet 512 and an outlet 514. An inlet end of the strap chute 48 is mounted to the rectangular box 510, by screws 516, so as to receive a strap from the outlet 514. The rectangular box 510, as shown, has two expansive faces 518 spaced from each other by a distance that is slightly greater than the width of the strap.

A brake 520 is mounted within the rectangular box 510 for pivotal movement about a pivot pin 522 extending between the expansive faces 518. The brake 520 has a teardrop shape, as shown, when viewed along the pivot pin 522. The brake 520 is biased, by a spring 524, in a direction indicated by a curved arrow in FIG. 9.

A guide 530 is mounted within the rectangular box 510 for pivotal movement about a pivot pin 532 extending between the expansive faces 518. The guide 530, which has a hub portion 534 and an arm portion 536 is pivotable between an initial position in which it is shown in full lines in FIG. 9 and a displaced position in which it is shown in phantom lines in FIG. 9. The brake 520 is biased, by the spring 524, against the hub portion 534.

The guide 530 is pivoted manually to its initial before a longitudinal strap, such as the longitudinal strap 14, is threaded initially into the strap chute 48, via the strap accumulator 46. Thus, the arm portion 536 directs the strap from the inlet 512 to the outlet 514. The brake 520, as biased against the hub portion 534, permits the strap to be fed into the strap accumulator 46, through the inlet 512.

When such strap is tensioned, the excess of the strap is fed back through the strap chute 48, into the strap accumulator 46. The excess being fed back into the strap accumulator 46 moves the guide 530 from its initial position to its displaced position. The brake 520, as biased against the hub portion 534, retards the excess against backing through the inlet 512.

Various modifications may be made in the strapping machine illustrated and described herein without departing from the scope and spirit of this invention.

I claim:

1. A binding machine for applying a binding element around a bundle, the binding machine comprising
   (a) means including a conveyor for conveying the bundle into a binding zone,
   (b) means including a binding head for applying the binding element in a tensioned loop, around the bundle in the binding zone,
   (c) means including a dispenser for supplying the binding element to the applying means, and
   (d) means including a chute for guiding the binding element between the dispenser of the supplying means and the binding head before the binding element is applied, the chute being curved and twisted so as to direct the binding element therebetween along a serpentine path with at least one curve and at least one twist.

2. A binding machine for applying a binding element around a bundle, the binding machine comprising
   (a) means including a conveyor for conveying the bundle longitudinally into a binding zone,
   (b) means including a binding head for applying the binding element in a tensioned loop having portions extending longitudinally around the bundle in the binding zone, and
   (c) means including a chute for guiding the binding element around the bundle in the binding zone before the binding element is applied, so as to guide the binding element into a loop having portions extending longitudinally, and for releasing the binding element when the binding element is applied, wherein the chute is curved and twisted so as to direct the binding element along a serpentine path with at least one curve and at least one twist and so as to avoid interfering with the bundle being conveyed longitudinally into the binding zone.

3. A binding machine for applying a binding element around a bundle, the binding machine comprising
   (a) means including a conveyor for conveying the bundle into a binding zone,
   (b) means including a binding head for applying the binding element in a tensioned loop, around the bundle in the binding zone,
   (c) means including a first chute for guiding the binding element before the binding element is applied, the first chute being curved and twisted so as to direct the binding element along a serpentine path with at least one curve and at least one twist, the first chute being arranged to avoid interfering with the bundle being conveyed into the binding zone, to guide the binding element around the bundle in the binding zone, and to release the binding element when the binding element is applied, (d) means including a dispenser for supplying the binding element to the applying means, and (e) means including a second chute for guiding the binding element between the dispenser of the supplying means and the binding head, the second chute being curved and twisted so as to direct the binding element along a serpentine path with at least one curve and at least one twist.

4. A strapping machine for applying two crossed straps of polymeric material, namely a transverse strap and a longitudinal strap, around a bundle, the strapping machine comprising (a) means including a conveyor for conveying the bundle into a strapping zone, (b) means including a strapping head for applying the transverse strap, in a tensioned loop, around the bundle in the strapping zone, (c) means including a transverse chute for receiving the transverse strap, for guiding the transverse strap around the bundle in the strapping zone, and for releasing the transverse strap when the transverse strap is applied, (d) means including a strapping head for applying the longitudinal strap, in a tensioned loop, around the bundle in the strapping zone, and (e) means including a longitudinal chute for receiving the longitudinal strap, for guiding the longitudinal strap around the bundle in the strapping zone, and for releasing the longitudinal strap when the longitudinal strap is applied, wherein the strapping zone has two opposite sides and two opposite ends, wherein the transverse chute arches from one such side of the strapping zone to the other side of the strapping zone, and wherein the longitudinal chute arches from one such end of the strapping zone to the other end of the strapping zone but is curved and twisted so as to be laterally displaced from the strapping zone at each such end, thereby to avoid interfering with the bundle being conveyed into the strapping zone.

5. The strapping machine of claim 4 wherein the longitudinal chute is curved and twisted so as to be laterally displaced to the same side at each such end, thereby to avoid interfering with the bundle being conveyed into the strapping zone.

6. The strapping machine of claim 4 comprising (f) means including a conveyor for conveying the bundle from the strapping zone after the transverse and longitudinal straps have been applied around the bundle.

7. The strapping machine of claim 6 wherein the longitudinal chute is curved and twisted so as to be laterally displaced to the same side at each such end, thereby to avoid interfering with the bundle being conveyed into or from the strapping zone.

8. The strapping machine of claim 4 comprising (f) means including a deflector for deflecting the strap released by the curved and twisted chute so as to center the deflected strap within the strapping zone.

9. The strapping machine of claim 5 comprising (f) means including a deflector for deflecting the strap released by the longitudinal chute so as to center the deflected strap between the opposite sides of the strapping zone.

10. The strapping machine of claim 6 comprising (g) means for deflecting the strap released by the curved and twisted chute so as to center the deflected strap within the strapping zone.

11. The strapping machine of claim 7 comprising (g) means for deflecting the strap released by the longitudinal chute so as to center the deflected strap between the opposite sides of the strapping zone.

12. A method for applying a binding element around a bundle, the method comprising steps of (a) conveying the bundle into a binding zone, (b) supplying the binding element from a dispenser, (c) guiding the binding element between the dispenser and a binding head, before the binding element is applied, by means of a chute that is curved and twisted so as to direct the binding element along a serpentine path with at least one curve and at least one twist, and (d) applying the binding element, in a tensioned loop, around the bundle in the binding zone by means of the binding head.

13. A method for applying a binding element around a bundle, the method comprising steps of (a) conveying the bundle longitudinally into a binding zone, (b) guiding the binding element around the bundle in the binding zone before the binding element is applied, by means of a chute arranged to guide the binding element into a loop having portions extending longitudinally and to release the binding element when the binding element is applied, and (c) applying the binding element, in a tensioned loop having portions extending longitudinally, around the bundle in the binding zone by means of a binding head, wherein the chute is curved and twisted so as to direct the binding element along a serpentine path with at least one curve and at least one twist and so as to avoid interfering with the bundle being conveyed longitudinally.

14. A method for applying a binding element around a bundle, the method comprising steps of (a) conveying the bundle into a binding zone, (b) guiding the binding element, before the binding element is applied, by means of a chute that is curved and twisted so as to direct the binding element along a serpentine path with at least one curve and at least one twist, and (c) applying the binding element, in a tensioned loop, around the bundle in the strapping zone by means of a binding head, wherein the chute used in step (b) is a first chute and wherein step (b) is preceded by steps of supplying the binding element from a dispenser and guiding the binding element between the dispenser and the binding head by means of a second chute that is curved and twisted so as to direct the binding element along a serpentine path with at least one curve and at least one twist.

15. A method for applying crossed straps of polymeric material, namely a transverse strap and a longitudinal strap, around a bundle, the method comprising steps of (a) conveying the bundle into a strapping zone, (b) guiding the transverse strap around the bundle in the strapping zone, through a transverse chute adapted to release the transverse strap when the transverse strap is applied, (c) applying the transverse strap, in a tensioned loop, around the bundle in the strapping zone by means of a strapping head, (d) guiding a longitudinal strap around the bundle in the strapping zone, through a longitudinal chute adapted to release the longitudinal strap when the longitudinal strap is applied, and (e) applying the longitudinal strap, in a tensioned loop, around the bundle in the strapping zone by means of a strapping head, wherein at least one of the transverse and longitudinal chutes is curved and twisted so as to direct such a strap, as guided by the same one of said chutes, along a serpentine path with at least one curve and at least one twist, wherein the strapping zone has two opposite sides and two opposite ends, wherein the transverse chute arches from one such side of the strapping zone to the other side of the strapping zone, and wherein the longitudinal chute arches from one such end of the strapping zone to the other end of the strapping zone but is curved and twisted so as to be laterally displaced from the strapping zone at each such end, thereby to avoid interfering with such a bundle being conveyed into the strapping zone.

16. The method of claim 15 wherein the longitudinal chute is curved and twisted so as to be laterally displaced to the same side at each such end, thereby to avoid interfering with the bundle during step (a).

17. The method of claim 15 comprising a step of (f) conveying a bundle from the strapping zone after such transverse and longitudinal straps have been applied around the last-mentioned bundle, wherein the strapping zone has two opposite sides and two opposite ends, wherein the transverse chute arches from one such side of the strapping zone to the other side of the strapping zone, and wherein the longitudinal chute arches from one such end of the strapping zone to the other end of the strapping zone but is curved and twisted so as to be laterally displaced from the strapping zone at each such end, thereby to avoid interfering with such a bundle being conveyed into or from the strapping zone.

18. The method of claim 17 wherein the longitudinal chute is curved and twisted so as to be laterally displaced to the same side at each such end, thereby to avoid interfering with the bundle during steps (a) and (f).

19. The method of claim 15 comprising a step of (f) deflecting the strap released by the curved and twisted chute so as to center the deflected strap within the strapping zone.

20. The method of claim 16 comprising a step of (f) deflecting the strap released by the longitudinal chute so as to center the deflected strap between the opposite sides of the strapping zone.

21. The method of claim 17 comprising a step of (g) deflecting such a strap released by the curve and twisted chute so as to center the deflected strap within the strapping zone.

22. The method of claim 18 comprising a step of (g) deflecting the strap released by the longitudinal chute so as to center the deflected strap between the opposite sides of the strapping zone.

* * * * *